US011266958B2

(12) United States Patent
Bishop

(10) Patent No.: US 11,266,958 B2
(45) Date of Patent: Mar. 8, 2022

(54) DRY ADDITIVE AND FLUID MIXING SYSTEM, ASSEMBLY AND METHOD

(71) Applicant: MGB OILFIELD SOLUTIONS, L.L.C., Houston, TX (US)

(72) Inventor: Mark Daniel Bishop, Katy, TX (US)

(73) Assignee: MGB OILFIELD SOLUTIONS, LLC, Katy, TX (US)

( * ) Notice: Subject to any disclaimer, the term of this patent is extended or adjusted under 35 U.S.C. 154(b) by 482 days.

(21) Appl. No.: 16/246,433

(22) Filed: Jan. 11, 2019

(65) Prior Publication Data

US 2019/0217258 A1 Jul. 18, 2019

Related U.S. Application Data

(60) Provisional application No. 62/617,164, filed on Jan. 12, 2018.

(51) Int. Cl.

| | |
|---|---|
| ***B01F 3/00*** | (2006.01) |
| ***B01F 3/12*** | (2006.01) |
| ***B01F 13/00*** | (2006.01) |
| ***B01F 15/02*** | (2006.01) |

(52) U.S. Cl.

CPC ..... *B01F 3/1271* (2013.01); *B01F 13/0032* (2013.01); *B01F 15/0234* (2013.01); *B01F 2003/125* (2013.01); *B01F 2215/0081* (2013.01)

(58) Field of Classification Search

CPC ..... B01F 3/1271; B01F 2003/125; B01F 13/0032; B01F 15/0234; B01F 2215/0081

See application file for complete search history.

(56) References Cited

U.S. PATENT DOCUMENTS

| | | | | |
|---|---|---|---|---|
| 4,159,180 | A | 6/1979 | Cooper et al. | |
| 4,265,266 | A | 5/1981 | Kierbow et al. | |
| 4,715,721 | A | 12/1987 | Walker et al. | |
| 5,114,239 | A * | 5/1992 | Allen | B01F 3/04836 366/136 |

(Continued)

FOREIGN PATENT DOCUMENTS

| | | |
|---|---|---|
| GB | 2524809 | 10/2015 |

OTHER PUBLICATIONS

PCT Notificiation of Transmittal of the International Search Report and the Written Opinion of the International Searching Authority, or the Declaration; dated Apr. 10, 2019; International Application No. PCT/US2019/013385; International Searching Authority, United States Patent and Trademark Office.

(Continued)

*Primary Examiner* — Anshu Bhatia

(74) *Attorney, Agent, or Firm* — The Compton Law Firm, P.C.; Scott D. Compton

(57) ABSTRACT

The application is directed to a system and method for mixing fluid and dry material to produce fluid mixture compositions. The system may be provided on a portable platform for transport of the system for use at different locations or the system may be provided as a permanent installation. The system includes a first module for receiving fluid into the system and an optional second module attachable to the first module for providing dry material to be mixed with the fluid received into the system. The fluid mixture compositions produced by the system can be conveyed out from the system to one or more target locations.

18 Claims, 28 Drawing Sheets

(56) References Cited

U.S. PATENT DOCUMENTS

| | | | |
|---|---|---|---|
| 7,926,564 | B2 | 4/2011 | Phillippi et al. |
| 9,022,120 | B2 | 5/2015 | Zamora et al. |
| 2008/0257449 | A1 | 10/2008 | Weinstein et al. |
| 2008/0264641 | A1 | 10/2008 | Slabaugh et al. |
| 2009/0078410 | A1 | 3/2009 | Krenek et al. |
| 2010/0319921 | A1 | 12/2010 | Eia et al. |
| 2014/0041317 | A1 | 2/2014 | Pham et al. |
| 2014/0364344 | A1 | 12/2014 | Weinstein et al. |
| 2015/0016209 | A1 | 1/2015 | Barton et al. |
| 2015/0322761 | A1 | 11/2015 | Hodgson et al. |
| 2017/0259223 | A1 | 9/2017 | Logan et al. |

OTHER PUBLICATIONS

Bishop, Claims 1-13 of International Application No. PCT/US2019/013385; dated Jan. 11, 2019.

* cited by examiner

DRY ADDITIVE AND FLUID MIXING SYSTEM, ASSEMBLY AND METHOD

CROSS-REFERENCE TO RELATED APPLICATIONS

This application claims benefit of U.S. Provisional Patent Application Ser. No. 62/617,164, filed on Jan. 12, 2018, the content of which is hereby incorporated by reference in its entirety.

STATEMENT REGARDING FEDERALLY SPONSORED RESEARCH OR DEVELOPMENT

Not applicable.

FIELD OF THE INVENTION

The application relates generally to the mixing of dry additives and fluids.

BACKGROUND OF THE INVENTION

On-site mixing of dry additives with fluids is a common operation in many industries, including for example, oilfield operations, mining, pulp industry, paper industry, pharmaceutical preparation, food preparation and processing, cosmetics industry, plastics industry, construction and agriculture. However, on-site mixing is not without its challenges. For example, many on-site mixing locations are remote and present logistical challenges such as long travel distances, limited transportation infrastructure, hostile climates and primitive or crude chemical storage conditions for dry additives and/or liquids. In an attempt to overcome such challenges batch mixing has been employed by producing batch mixtures at one location, i.e., a mixing facility, and then transporting the batch mixtures in tote tanks or bulk liquid trailers to a second location for use, e.g., a petroleum wellsite or a production facility. However, transportation costs for transporting batch mixtures to certain locations are high. Batch mixing has also been attempted on-site but relies heavily on the storage of dry products on location and often times there is no space available for such material storage. In addition, batch mixing can often be wasteful. For example, at the conclusion of a batch mixing operation it is not uncommon for fluid mixtures to remain in the bottom of the tanks or containers utilized. Depending on the type of fluid mixture, the mixture may have to be treated and/or transported to a safe disposal site. Also, during transit and depending on the chemistry of the mixture, a batch mixture may be subject to chemical reactions and temperature degradation thereby damaging the mixture before reaching its destination.

For many on-site mixing operations, batch mixing has largely been replaced by continuous mixing, which occurs when separate streams of ingredients are continuously fed and combined in some container, mixed, and the mixture removed continuously. Continuous mixing is often valuable in those operations that require the ability to mix dry additives and base fluids on the fly out in the field. However, in many industries, especially in the extraction of oil and gas, and specifically in hydraulic fracturing operations, the use of liquid chemicals on-site in continuous mixing operations is also cost prohibitive. There have been attempts to create continuous mixing packages that are field transportable but such have several shortcoming including: (1) the large size of mixing units currently available (length, width, depth), (2) the substantial weight of units currently available, (3) the complexity of current designs, which can make maintenance and operating such units challenging and adds costs depending on the location of operation, (4) component failures leading to the asset not being available to perform operations as necessary, (5) the inability to remotely operate the mixing units, (6) the lack of quality and control of the mixing process necessary to provide one or more required fluid mixtures and (7) supply chain challenges, e.g., bulk material needs to be transported in large pneumatic trailers to the field.

Overcoming the above shortcomings is desired.

BRIEF SUMMARY OF THE INVENTION

The present application is directed to a system for producing fluid mixture compositions, including a first module providing one or more fluids; and a second module attachable to the first module providing one or more dry additives to be mixed with the one or more fluids in the first module to produce a fluid mixture composition; wherein the first module is operationally configured to modify the fluid mixture composition.

The present application is also directed to a portable system for mixing fluid and dry material, including a first module providing a fluid stream; a second module providing dry material into the fluid stream to produce a fluid mixture composition; the first module being operationally configured to house the fluid mixture composition, modify the fluid mixture composition and direct the fluid mixture composition out from the system.

The present application is also directed to a system for mixing fluid and dry material, including a first module for receiving fluid into the system; and a second module attachable to the first module for providing dry material to be mixed with the fluid in the first module producing a fluid mixture composition; wherein the first module includes a first mixer for producing the fluid mixture composition and a second mixer to facilitate further mixing of the fluid mixture composition; the first module being operationally configured to direct the fluid mixture composition out from the system via one or more outlets.

DETAILED DESCRIPTION OF THE INVENTION

Figure 1:
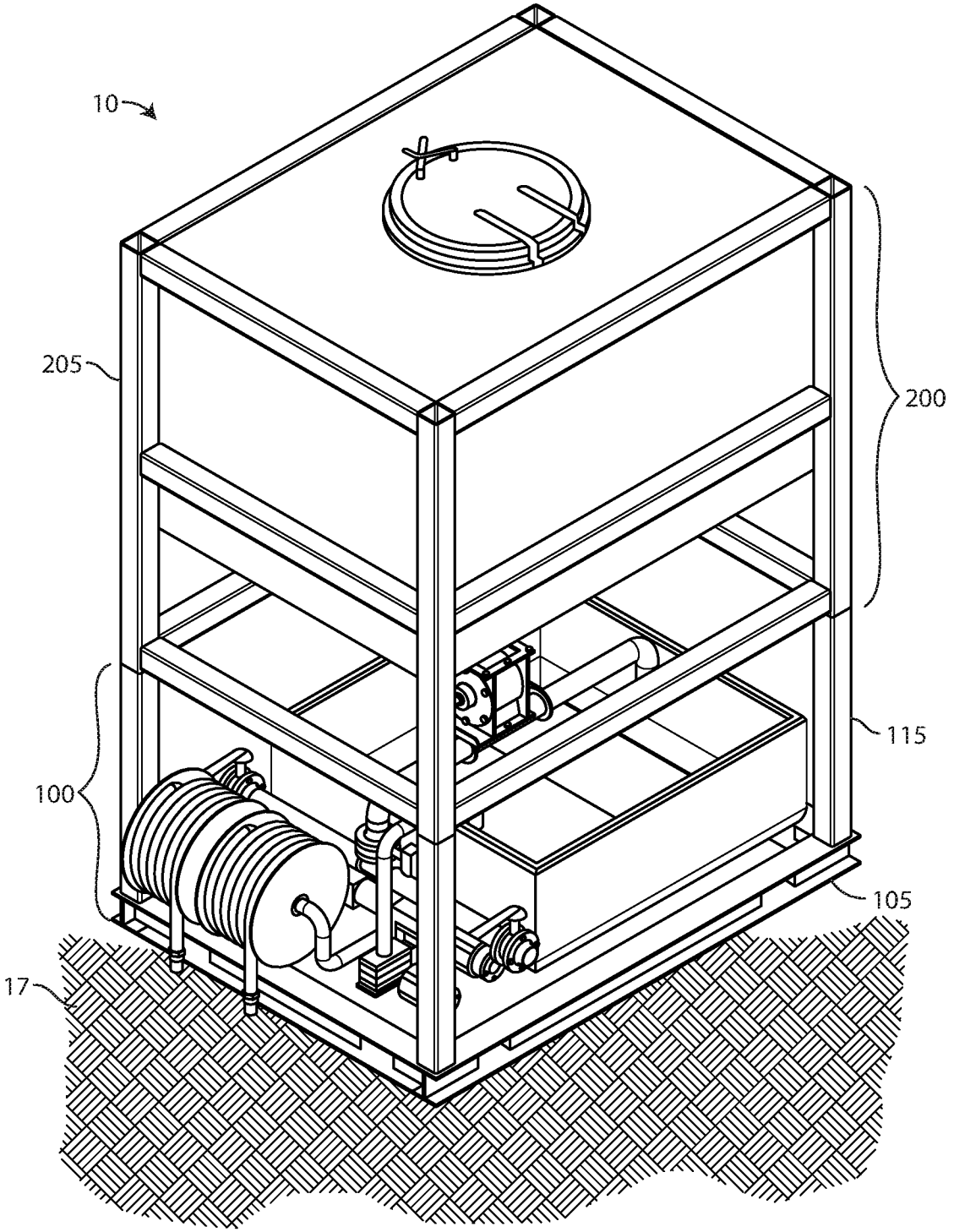
FIG. 1 is a perspective view of an embodiment of the system of this application.

Before describing the invention in detail, it is to be understood that the present system, assembly and method are not limited to particular embodiments. It is also to be understood that the terminology used herein is for the purpose of describing particular embodiments only, and is not intended to be limiting. As used herein, the term "on-site" refers to one or more remote locations or destinations serving as the place for producing fluid mixture compositions for a particular operations including, but not necessarily limited to temporary operations. As understood by the skilled artisan, "ISO" is an acronym for International Organization for Standardization.

In one aspect, the application provides a portable or mobile system, assembly and method for batch or continuous mixing of one or more fluids and dry materials to produce one or more fluid mixture compositions. In one aspect, the application provides for variable mixing according to one or more particular properties of the one or more fluid mixture compositions to be produced. For example, the system may be programmed to mix one or more fluids and one or more dry materials via a first mixing action or procedure to produce one or more fluid mixture compositions defined by particular properties. The system may also be programmed to mix one or more fluids and one or more dry materials via one or more additional mixing actions or procedures following a first mixing to produce one or more fluid mixture compositions having one or more properties different than the fluid mixture compositions produced via the first mixing action.

In another aspect, the application provides a portable system for continuous mixing of one or more fluids and one or more dry additives on-site, the system comprising an assembly having separate compartments for holding dry additives and fluid mixture compositions. The compartments may vary in size and shape. In one aspect, the portable system is operationally configured for mobile mixing applications. In another aspect, the portable system may be installed for permanent use at a particular location.

In another aspect, the application provides a method for introducing a dry additive into a fluid stream in a way that ensures a predictable, highly accurate and consistent application of the dry additive to produce one or more particular fluid mixture compositions.

In another aspect, the application provides a system for mixing fluid and dry additive material in a manner effective to minimize dead spots in a mixing vessel where ingredients may stagnate rather than mix.

In another aspect, the application provides a system for mixing fluid and dry additive material to produce one or more fluid mixture compositions in a manner effective to control the output flowrate and output density of the fluid mixture compositions produced.

As described below, the present application is directed to a cost effective approach to storing, transporting and mixing dry material and fluid at a particular location compared to other known technologies. In particular, the present application is directed to an invention including a system made up of individual members that may be separately transported to one or more locations and cooperatively assembled to produce fluid mixture compositions comprising dry material and fluid on demand. In one implementation, individual members of the system may store and transport dry additive and/or fluid to one or more locations where after the dry additive and fluid may be mixed together. In another implementation, individual members may be transported to one or more locations and dry material and/or fluid may be delivered or fed to the individual members on-site for mixing dry additive and fluid. In yet another implementation of the system, one or more individual members may be used to transport dry material to one or more locations and be assembled on-site with one or more other individual members operationally configured to receive the dry material and one or more fluids at one or more flow rates to produce one or more volumes of fluid mixture compositions. As described herein, the system suitably provides for the transport, assembly, disassembly, interchangeability of individual members at one or more target locations.

One exemplary embodiment of a primary system 10 of this application is provided in FIG. 1. As shown, a primary system 10 (hereafter "system 10") may include at least a first individual member in the form of a mobile or transportable first module 100 and a second individual member in the form of a mobile or transportable second module 200 operationally configured to be assembled with the first module 100 for system 10 operation.

Figure 2:
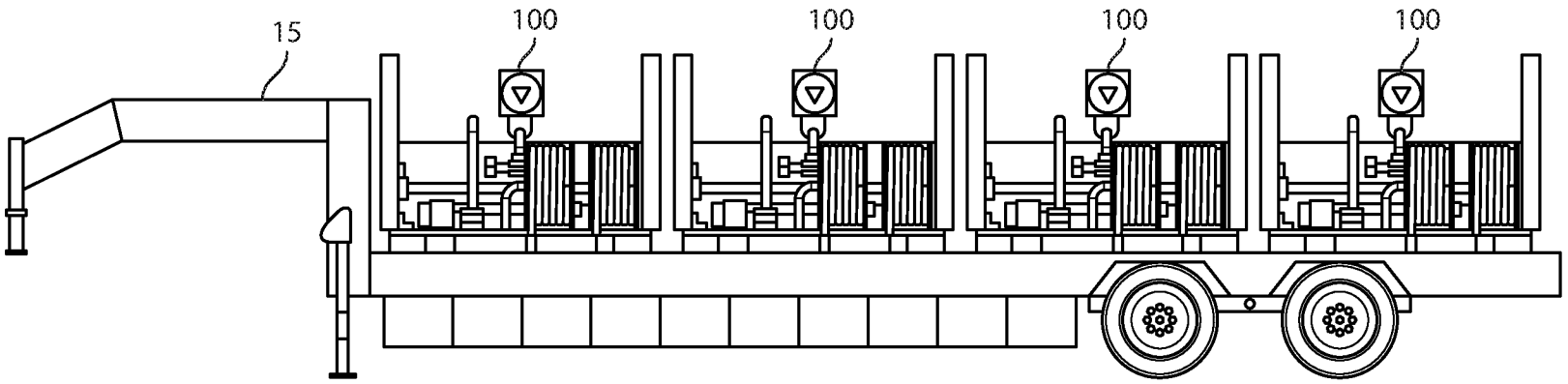
FIG. 2 is an illustration of four first modules on a flatbed trailer for transport.
Figure 3:
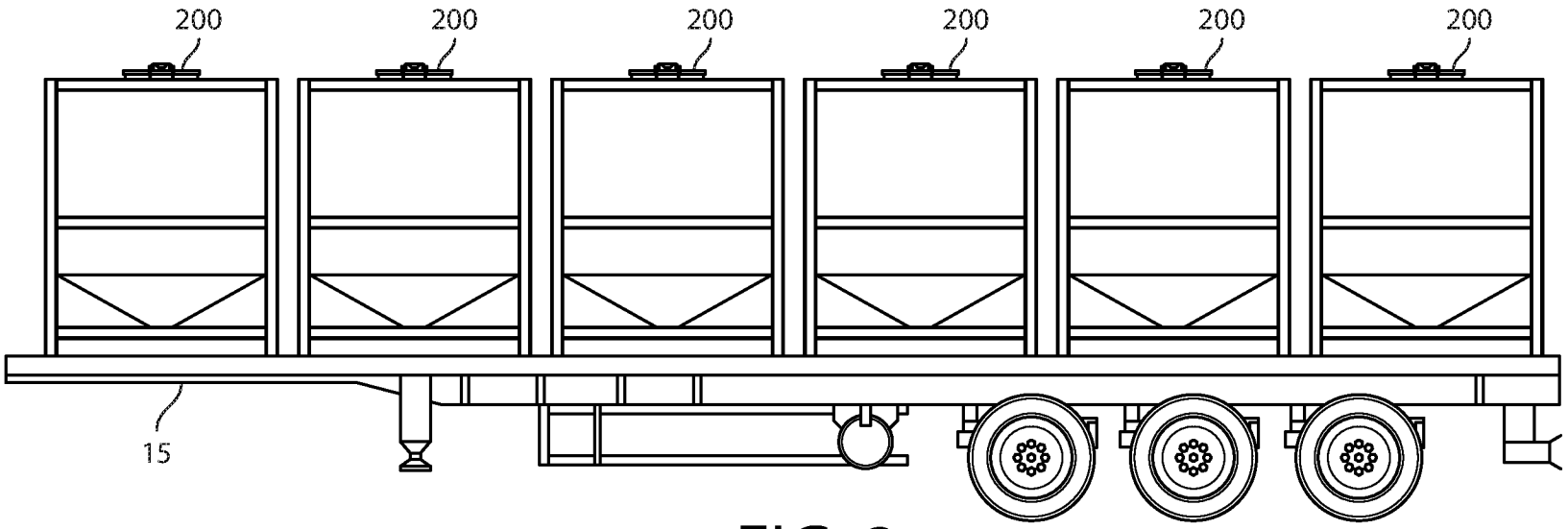
FIG. 3 is an illustration of six second modules on a flatbed trailer for transport.
Figure 4:
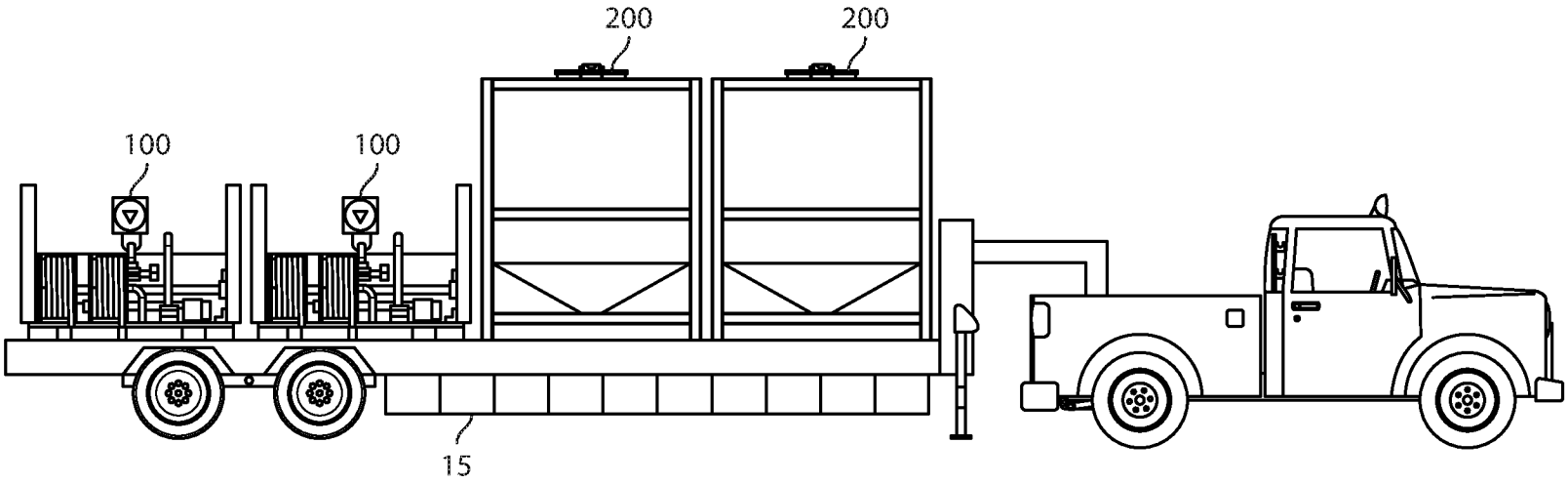
FIG. 4 is an illustration of two first modules and two second modules on a flatbed trailer for transport.
Figure 5:
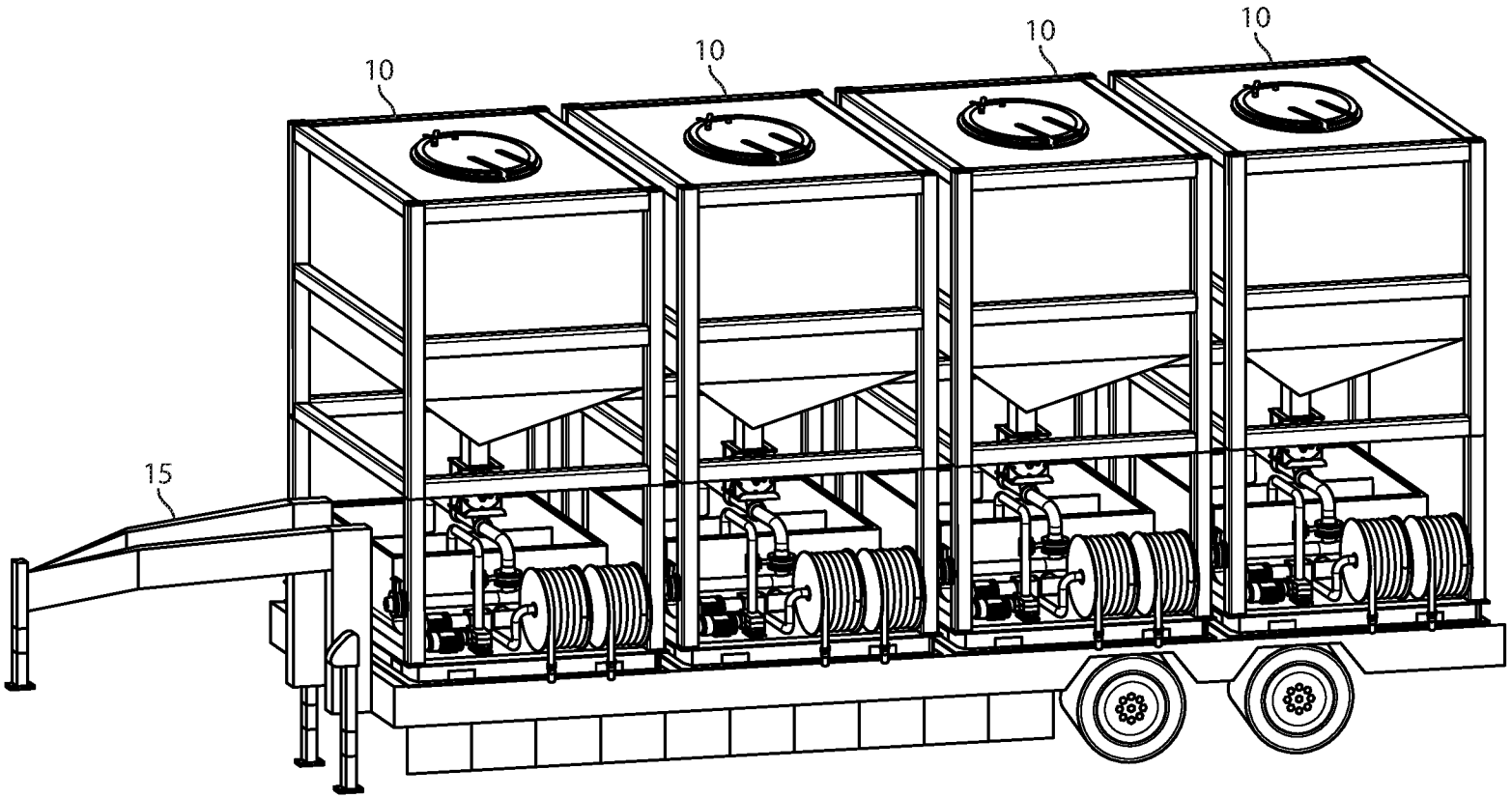
FIG. 5 is an illustration of four systems on a flatbed trailer for transport.

One advantageous feature of the present system 10 is the mobility of individual modules 100, 200. For example, first and second modules 100, 200 may be transported as individual units as shown in the examples of FIGS. 2-4. In another mode, first and second modules 100, 200 may be assembled for transport as shown in FIG. 5, which depicts multiple systems 10 side by side on a flatbed trailer 15. As discussed below, the modules 100, 200 are operationally configured for ease of transport, stackability and storage. In addition to flatbed trailers 15, the modules 100, 200 are also operationally configured for transport via closed shipping containers, semi-trailer truck enclosed cargo spaces, boxcars, and other shipping techniques. Accordingly, the first module 100 and/or second module 200 may be provided with a tracking device such as a GPS tracking unit utilizing the Global Positioning System, or equivalent, in order to track their precise location at any given moment during transport.

In basic system 10 operation, the first module 100 serves as a primary source of fluid and the second module 200 serves as a primary source of dry material or non-fluid material (hereafter referred to as "dry additive") for mixing purposes. In one mode of operation, one or more dry additives may be fed from the second module 200 to the first module 100 whereby dry additive can be mixed with one or more fluids to produce a fluid mixture composition that may be directed out from the first module 100 to one or more target locations downstream and/or upstream as desired. In one particular implementation, a first module 100 may store or receive a desired volume of fluid, i.e., one or more fluids, and the second module 200 may store or receive a desired amount of dry additive, i.e., one or more dry additives, to be fed to the first module 100 where the dry additive and fluid are mixed to produce a fluid mixture composition. Thus, in one implementation, the system 10 may be operationally configured as a batch mixer operationally configured to produce a batch fluid mixture composition of a desired volume on-site. In another implementation, the system 10 may be operationally configured as a continuous mixer with particular feed rates effective to produce one or more fluid mixture compositions in a continuous manner at a desired volumetric flow rate, e.g., over a particular period of time or intervals of time. As understood by the skilled artisan, continuous mixing typically produces higher volumes of fluid mixture compositions than batch mixing. For continuous mixing purposes, dry additive and fluid are fed to the first module 100 at desired feed rates in amounts effective to produce one or more desired fluid mixture compositions. In one embodiment, dry additive is suitably fed to the first module 100 as fluid is fed to the first module 100. However, it is further contemplated that for continuous mixing an amount of dry additive may be delivered to the first module 100 before and/or during and/or after fluid is fed to the first module 100.

As understood by the skilled artisan, assembly, storage and transportability of the system 10 may be dictated according to the structural elements of the first module 100 and/or its corresponding second module 200. As shown in FIG. 1, a first module 100 (or "mixing skid module") suitably includes a base support effective to hold first module 100 component parts and/or equipment and support a second module 200 in a manner effective to maintain the system 10 in an upright position on a support surface 17, e.g., the ground (earth), a trailer bed, floor, container bed, ship deck, skid, man-made foundation, as shown in FIG. 1.

Figure 6:
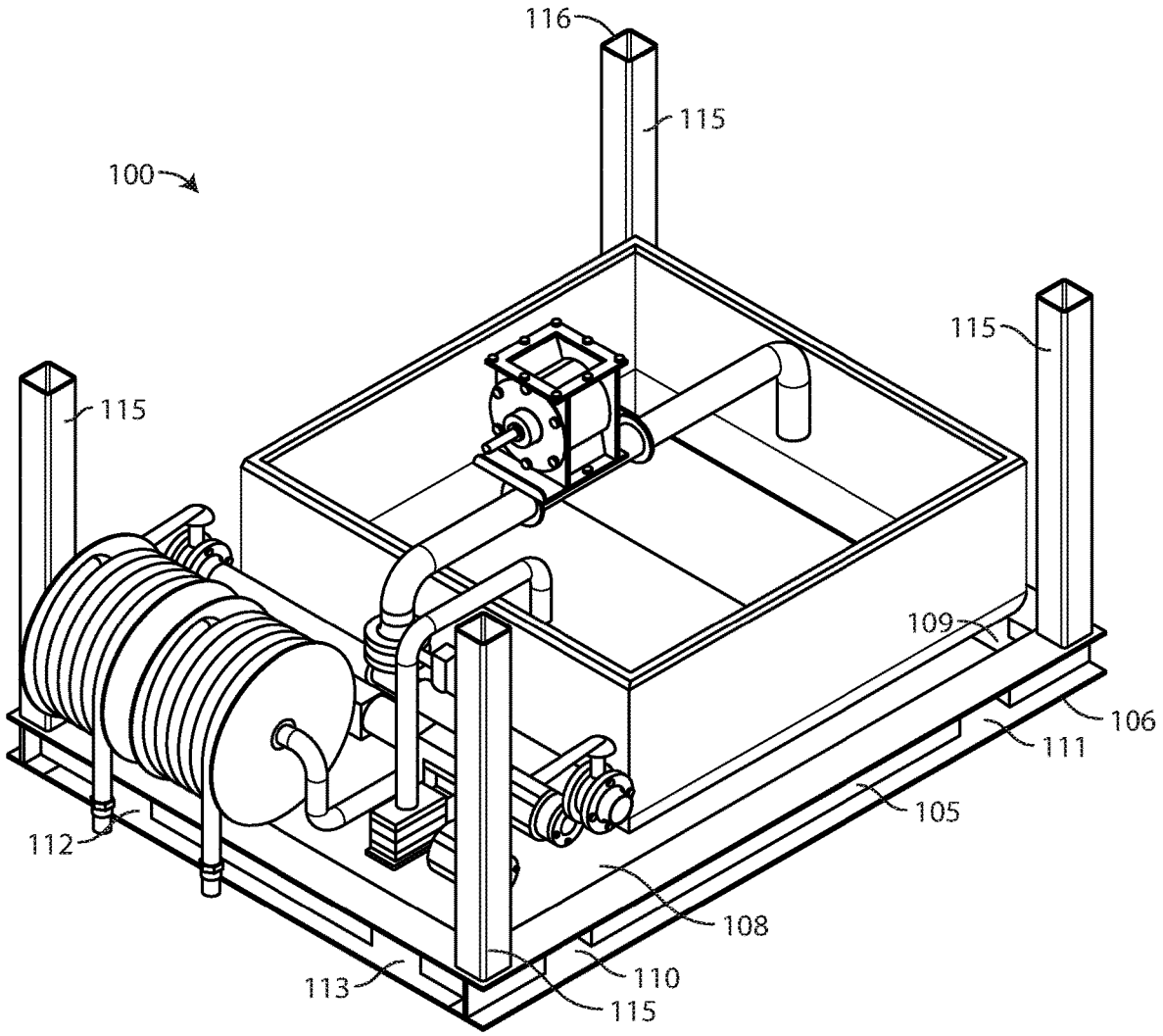
FIG. 6 is a perspective view of an embodiment of a first module of the present application.

With reference to FIG. 6, one suitable first module 100 may be provided as a fully contained skid type member with a base support surface comprising a framework 105 and a first support surface 108 disposed across the framework 105 operationally configured as a portable support platform or other platform type member effective to hold various component parts and/or equipment of the first module 100 as shown. The first support surface 108 may be provided as a sunken floor type member with a framework 105 providing an inner perimeter sidewall 109 operationally configured to contain liquid spills on the first support surface 108 within the first module 100. In another embodiment, the first support surface 108 may be provided as a removable planar type member placed atop the framework 105. In another embodiment, the framework 105 may include a grooved surface of a first depth along its perimeter for receiving a planar type first support surface 108 therein effective as a seat to support the first support surface 108 and prevent lateral movement of the first support surface 108—in such embodiment the first support surface 108 may include a thickness substantially similar as the first depth thereby providing a smooth or continuous base support surface across the framework 105 and first support surface 108. In another embodiment, a removable first support surface 108 may be secured to a framework 105 via one or more fasteners such as threaded fasteners. In still another embodiment, the framework 105 and first support surface 108 may be provided as a single unit, e.g., a first support surface 108 adhered to a framework 105. In an embodiment comprising metal components, a first support surface 108 may be welded to a framework 105. In still another embodiment, a base support surface of a first module 100 may be provided as a machined or molded one-piece member.

As further shown in FIG. 6, the first module 100 may also include one or more raised members for engaging and supporting a second module 200 apart from the component parts and/or equipment of the first module 100 in a stacked type configuration. As FIG. 6 illustrates, one suitable first module 100 may include one or more raised members in the form of one or more elongated vertical members 115 operationally configured to receive a second module 200 in a stacked configuration upon the vertical members 115. As shown in the simplified illustration of FIG. 7, in another embodiment one or more raised surfaces may include horizontal rail type support members 114 on opposing sides of the first module 100 operationally configured to receive a second module 200 in a stacked orientation thereon. In another embodiment as exemplified in FIG. 8, a raised horizontal rail type support member 114 may be provided along the perimeter of the framework 105 operationally configured to receive a second module 200 in a stacked orientation thereon. In such embodiment, the first module 100 may further include one or more planar type radial triangular type supports disposed between the rail type support member 114 and the first support surface 108 as provided in U.S. Patent No. D688349, titled "Proppant Vessel Base," issued on Aug. 20, 2013, which is herein incorporated by reference in its entirety. Suitably, the one or more elongated vertical members 115, the horizontal rail type support members 114 and radial supports provide structural support to the system 10.

Figure 9:
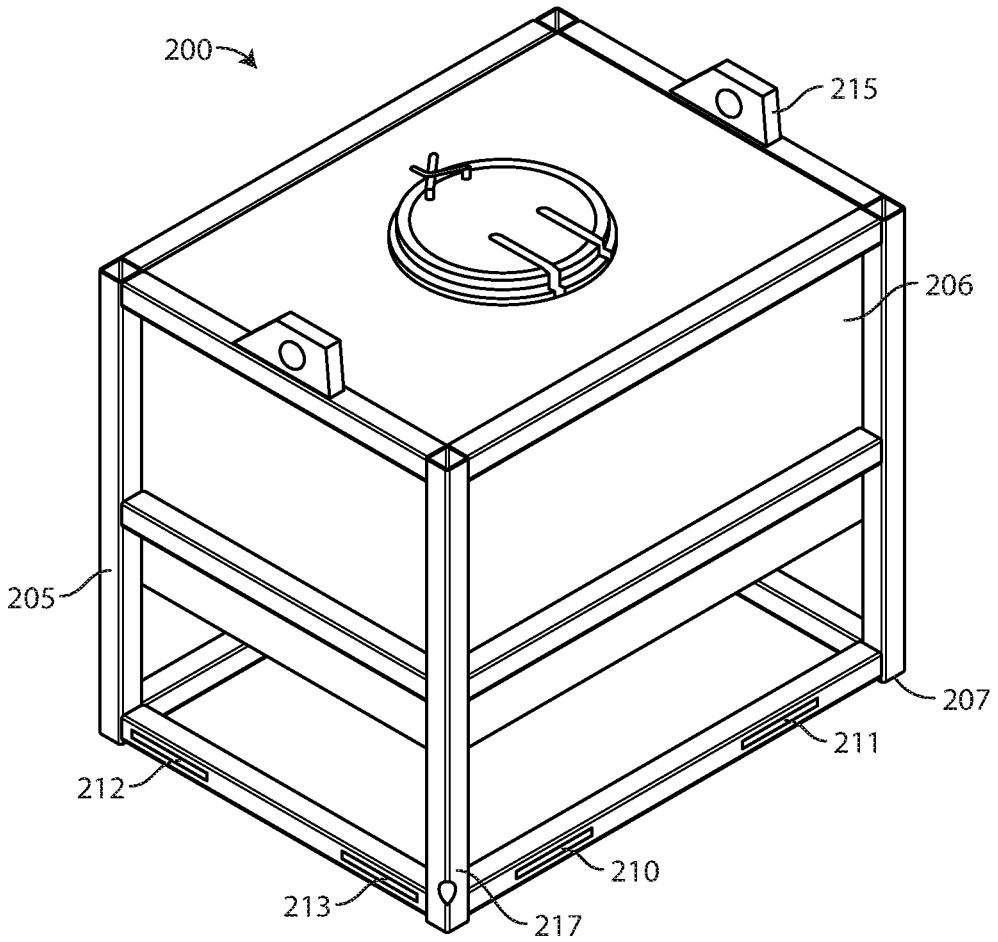
FIG. 9 is a perspective view of an embodiment of a second module of the present application.

Turning to FIG. 9, the second module 200 includes a support framework 205 operationally configured to engage the first module 100 during system 10 assembly and operation as shown in FIG. 1. One suitable second module 200 may include a rectangular framework 205 with horizontal and vertical sections operationally configured to provide structural support for one or more dry additive storage containers 206 secured to the framework 205. In another embodiment, the framework 205 may including additional bracing members such as diagonal bracing members as known in the field of box type frames. As shown, one suitable framework 205 may include a rectangular perimeter substantially similar as, or the same as, the perimeter defined by the one or more vertical members 115 or horizontal rail type support members 114 of a corresponding first module 100. As shown in FIG. 9, the framework 205 suitably includes one or more engagement surfaces 207 effective to contact the one or more vertical members 115 and/or horizontal rail type support members 114 of a corresponding first module 100 during assembly of the system 10. In addition, it is further contemplated that the perimeters of the frameworks 105, 205 may be provided in shapes other than rectangular configurations. For example, frameworks 105, 205 may include non-rectangular multi-sided perimeters, e.g., triangular, hexagonal, as well as circular, oval, and one or more irregular shapes. It is also contemplated that the frameworks 105, 205 may be provided with differing perimeter shapes. Likewise, the frameworks 105, 205 may be sized and/or shaped to meet the spacing demands at a particular location for intended operation of the system 10.

Figure 11:
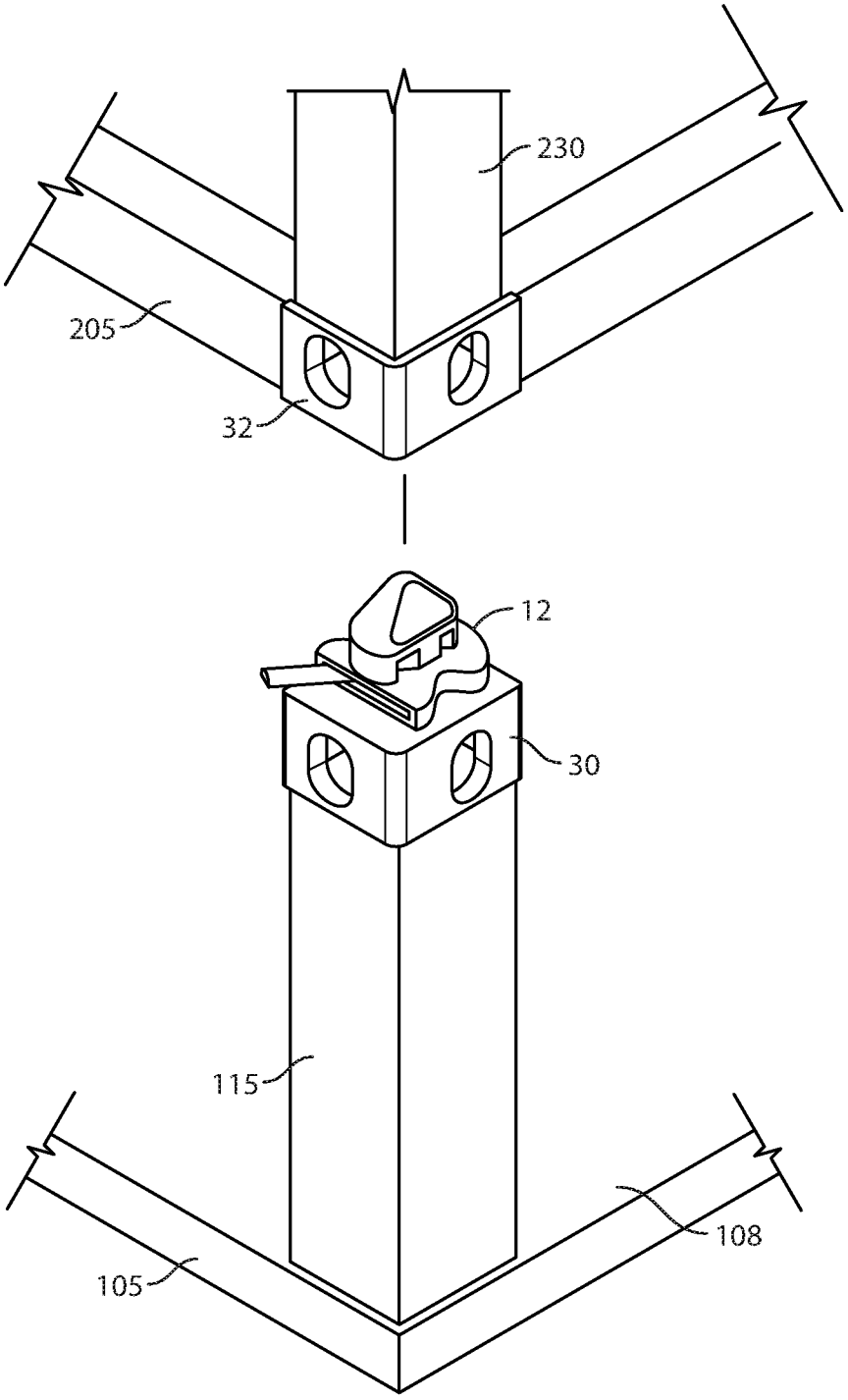
FIG. 11 is a perspective view illustration including the securing of an embodiment of a second module with an embodiment of a first module.

Without limiting the mode of assembly of the first and second modules 100, 200, a second module 200 as shown in FIG. 9 may be secured to the first module 100 via one or more locks, clamps, sleeves, rope, chain, bungee cords, tape, tie-wraps, bridge fittings, threaded fasteners, and combinations thereof, as desired or as otherwise required. In another embodiment, the one or more vertical members 115, or horizontal rail type support members 114, and the framework 205 may be constructed to include corner castings or corner fittings 30 and 32 for securing the second module 200 to the first module 100 via horizontal connectors and/or twist locks 12 as known in the art of ISO container chassis connections (see FIG. 11).

In another embodiment, corner fittings 30 and 32 may be provided as separate component parts releasably attachable to the one or more vertical members 115, or horizontal rail type support members 114 and the framework 205. Appositely, once the system 10 is assembled the corner fittings 30 and 32 and twist locks 12 are operationally configured to prevent any undesired vertical and/or lateral movement of the second module 200 in relation to the first module 100.

Suitable corner fittings 30, 32 and twist locks 12 are commercially available from sources including, but not necessarily limited to TANDEMLOC, Inc, Havelock, N.C., U.S.A. As understood by the skilled artisan, at the time of this application other commercial sources of corner fittings 30, 32 and/or twist locks 12 may be found via the World Wide Web at www.Alibaba.com.

Figure 10:
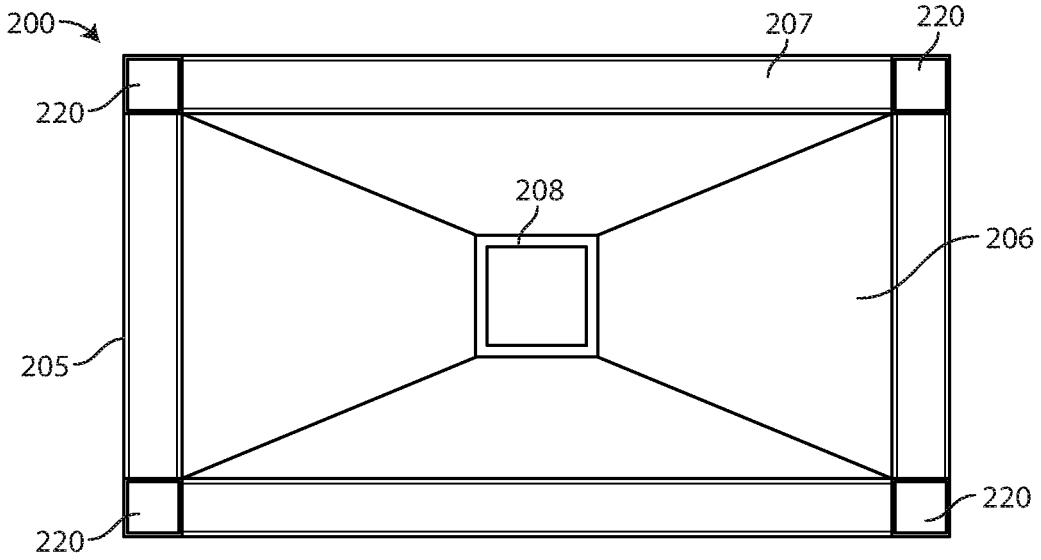
FIG. 10 is a bottom view of an embodiment of a second module.

In another mode of attachment, the one or more vertical members 115 may be operationally configured to act as male members for mating with corresponding female openings 220 (see FIG. 10) of the framework 205 of the second module 200. In such embodiment, the one or more vertical members 115 are effective as guides for aligning the second module 200 with the first module 100 as the second module 200 is being assembled with the first module 100. In one simplified embodiment, the one or more vertical members 115 and the corresponding vertical sections 230 of the framework 205 may include one or more corresponding vertically aligned holes for receiving a quick release pin there through for adjusting the distance between the first and second modules 100, 200. Such mechanical connection is well-known to persons of ordinary skill in the art. For exemplary purposes, a simplified quick release pin configuration suitable for the present application is described in U.S. Pat. No. 3,855,946, titled "Adjustable Leg Structure," issued on Dec. 24, 1974; and U.S. Pat. No. 6,053,477, titled "Self Levering Vehicle Jack," issued on Apr. 25, 2000, each of which is herein incorporated by reference in its entirety. In still another embodiment, the one or more vertical members 115 may be provided as telescoping members as described in U.S. Pat. No. 5,101,215, titled "Telescoping Lightweight Antenna Tower Assembly and the Like," issued on Mar. 31, 1992, herein incorporated by reference in its entirety. In another embodiment, a lock may be employed as described in U.S. Pat. No. 4,596,484, titled "Lock for Telescoping Tubular Support," issued on Jun. 24, 1986, which is herein incorporated by reference in its entirety.

Figure 12:
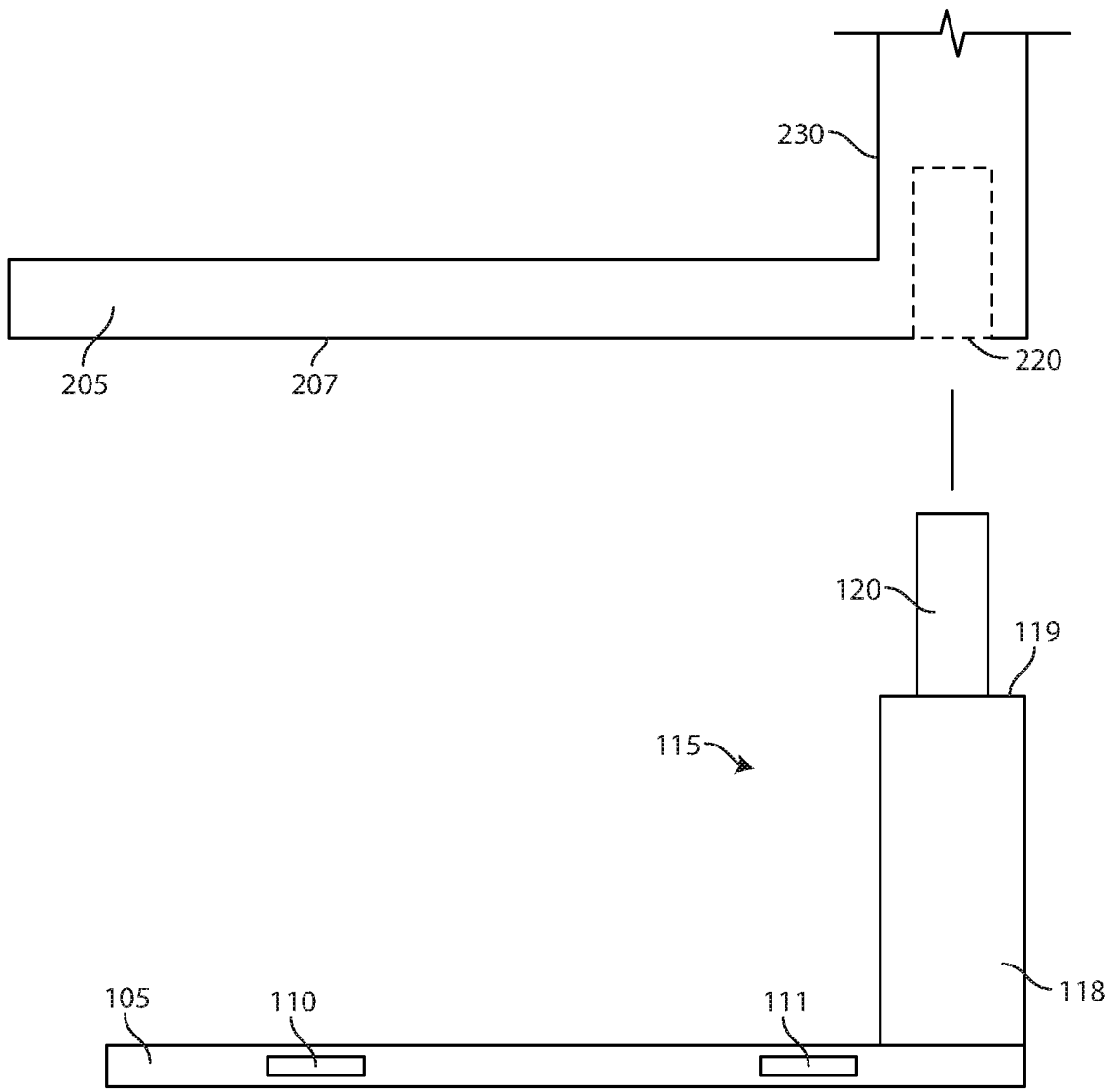
FIG. 12 is a side view illustration including the securing of an embodiment of a second module with an embodiment of a first module.

As shown in FIG. 12, another suitable vertical member 115 may be include a stepped member having (1) a first male type section 118 defined by a first outer width or outer diameter providing an abutment surface 119 for an engagement surface(s) 207 of the framework 205 and (2) a second male type section 120 defined by a second outer width or outer diameter extending out from the abutment surface 119 for mating with a female opening 220 of a vertical section 230 of the framework 205. In another embodiment, the one or more vertical members 115 may be provided as hollow members with openings 116 at the distal ends as shown in FIG. 6 operationally configured to receive male type vertical members 223 (FIG. 13) of the second module 200. In such embodiment, the one or more vertical members 223 are effective to prevent any undesired lateral movement of the second module 200 in relation to the first module 100 during system 10 assembly. One non-limiting mode of attachment in regard to vertical members 223 is provided in U.S. Pat. No. 6,366,313, titled "Height-Adjustable Support Assembly, Particularly Suited for Food Processing Equipment," issued on Apr. 2, 2002, which is herein incorporated by reference in its entirety.

Figure 14:
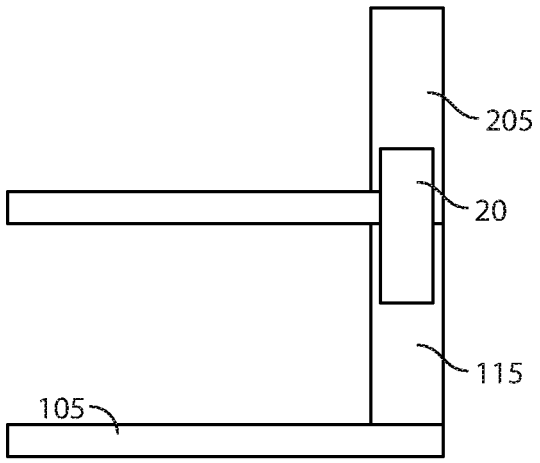
FIG. 14 is a side view illustration including the securing of an embodiment of a second module with an embodiment of a first module.
Figure 15A:
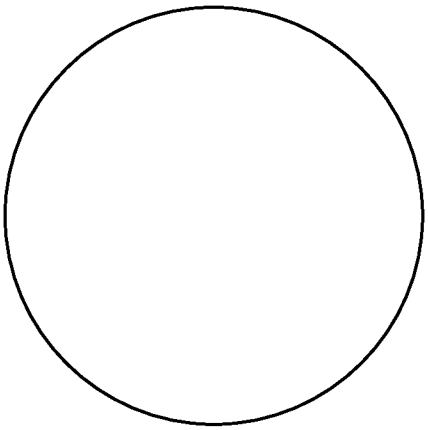
FIGS. 15A-15F provide exemplary perimeter shapes of one or more vertical members of a first module.
Figure 15D:
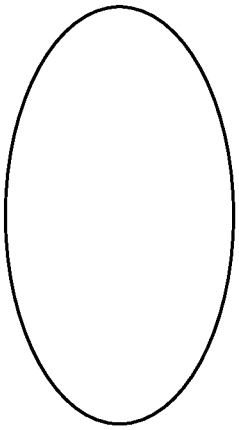
Figure 15B:
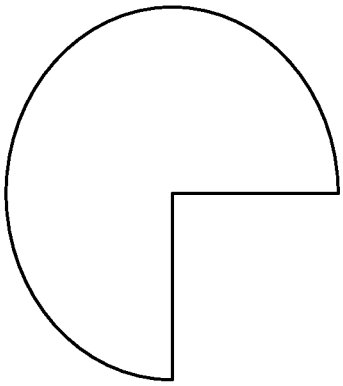
Figure 15E:
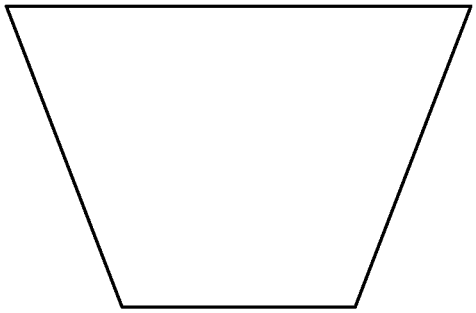
Figure 15C:
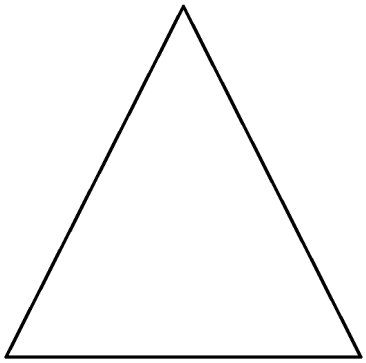
Figure 15F:
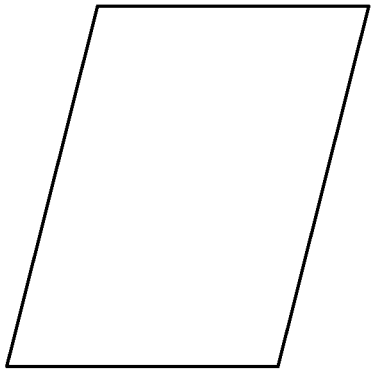

In another embodiment the system 10 may include an elongated connector 20 operationally configured to mate with a female opening 220 of framework 205 and a female opening 116 of a hollow vertical member 115 for securing the second module 200 with the first module 100 (see FIG. 14). In another embodiment, the second module 200 may be secured to the one or more vertical members 115 via an elongated connector 20 using a releasable pin as described in U.S. Pat. No. 6,158,705, titled "Vehicle Stabilization and Support Tool," issued on Dec. 12, 2000, which is incorporated herein by reference in its entirety.

With reference again to FIG. 8, in another embodiment the raised horizontal rail type support members 114 or the one or more vertical members 115 may include raised corner members 35 operationally configured to align and receive a framework 205 therein for system 10 assembly. In this embodiment, one or more apertures 217 located along the framework 205 (see FIG. 9) may be aligned with one or more apertures 37 of the corner plates in a manner effective for securing the first and second modules 100, 200 via one or more fasteners including, but not necessarily limited to threaded bolts, locking pins, and combinations thereof. The raised corner members 35 may also be used as lift eye type members for lifting and/or transporting the first module 100.

In one embodiment, the raised horizontal rail type support members 114 and the one or more vertical members 115 described above may be releasably attached to the framework 105 and/or releasably attached to the first support surface 108. Likewise, the male type vertical members 223 may be releasably attached to the framework 205. In another embodiment, the raised horizontal rail type support members 114 may include one or more vertical members 115 described herein that are permanently attached to framework 105 and/or the first support surface 108. Likewise, the one or more vertical members 223, may be permanently attached to the framework 205. In one embodiment, the horizontal rail type support member 114 and opposing vertical sections 115A, 115B may be provided as a single member, e.g., single member as three sides of a rectangle. In another embodiment, the opposing vertical sections 115A, 115B of a raised horizontal rail type support member 114 may be releasably or permanently attached to the support member 114.

Without limiting the mode of releasable type attachment, the raised horizontal rail type support members 114 and the one or more vertical members 115 may be releasably attached to the framework 105 and/or to the first support surface 108 and male type vertical members 223 may be releasably attached to framework 205 via set pins, clamps, twist locks 12 as described above. In another embodiment, the frameworks 105, 205 may include one or more threaded female openings for receiving threaded sections of corresponding vertical members 115, 223 therein. In another embodiment, vertical members 115, 223 may include threaded rod members extending out for mating with threaded female openings on the corresponding frameworks 105, 205—similar as furniture legs and the like known in the art that are equipped with threaded sections and/or threaded rod members. Non-limiting examples of threaded connections for use herein are provided in U.S. Pat. No. 5,561,950, titled "Method and Apparatus for Adjustable Pier Block," issued on Oct. 8, 1996; and U.S. Publication No. 20050056760, titled "Adjustable Beam Support," published on Mar. 17, 2005; each of which is incorporated herein by reference in its entirety. As understood by the skilled artisan, the height of the system 10 may vary according to the depth of mated threading achieved via threaded attachment. As such, threaded connections may be operationally configured to adjust or vary the height of the system 10. Still another embodiment of a vertical member 115, 223 contemplated for use herein is described in U.S. Pat. No. 6,213,452, titled "Railing Support Post," issued on Apr. 10, 2001, which is incorporated herein by reference in its entirety.

Even though the exemplary vertical members 115 of FIG. 6 are shown as elongated four-sided rectangular members, in another embodiment vertical members 115 may include another multi-sided configuration, e.g., three-sided, four-sided, five-sided, six-sided, and so forth. In another embodiment, the one or more vertical members 115 may be provided as cylindrical members and/or elongated members of another circular or curved perimeter shape and/or elongated members defined by irregular outer surface configurations. Exemplary perimeter shapes of the one or more vertical members 115 are provided in FIGS. 15A-15F. Other perimeter shapes of the one or more vertical members 115 are described in the above mentioned Provisional Application Ser. No. 62/617,164, the content of which is hereby incorporated by reference in its entirely. As such, even though interchangeability of the first and second modules 100, 200 may be desirable for many system 10 users, it is contemplated that one or more female openings may include a size and shape effective for mating with a particular size and/or shape vertical member 115, thereby dictating interchangeability of first and second modules 100, 200. Such matching of modules 100, 200 may be effective for reducing module theft by minimizing the interchangeability of modules 100, 200 amongst independent system 10 users provided with distinct type vertical member 115 sizes and/or shapes. Moreover, the system 10 may include one or more locks for securing the first and second modules 100, 200.

With reference again to FIG. 6, in one suitable embodiment the framework 105 may be configured to be lifted for transport via lifting equipment including, but not necessarily limited to mechanical lifts such as various types of forklifts, overhead cranes and hoists. For example, the framework 105 may include a height effective for providing (1) a first set of pockets 110, 111 along one or both sides of the first module 100 and/or (2) a second set of pockets 112, 113 along one or both ends of the first module 100 for receiving individual forks of a forklift, or other type of lift, in a manner effective to transport the first module 100 or an assembled system 10 to one or more on-site locations or other locations as shown in FIGS. 2-5, 18 and 19.

Similar as the first module 100, the framework 205 of the second module 200 may be operationally configured to be lifted for transport via lifting equipment including, but not necessarily limited to mechanical lifts such as various types of forklifts, overhead cranes and hoists. As shown in FIG. 9, the framework 205 may include a height effective for providing (1) a first set of pockets 210, 211 along one or both sides of the second module 200 and/or (2) a second set of pockets 212, 213 along one or both ends of the second module 200 for receiving individual forks of a forklift, or other type of lift, in a manner effective to transport the second module 100. The framework 205 may also include one or more lift eyes 215, handles, hook members, or the like for lifting and transporting the second module 200.

A first module 100 may also be equipped with wheels or casters for moving the first module 100 or an assembled system 10 across one or more surfaces, e.g., an on-site location for system 10 operation. In one embodiment, wheels or casters may be attached to the sides of the framework 105. In another embodiment, wheels or casters may be attached to the base surface 106 of the framework 105. In one particular embodiment, wheels or casters may include cylindrical threaded members for attachment to threaded female members of the framework 105. Similar as discussed above, the threaded members may be effective to vary the height of the system 10. Non-limiting examples of wheels or casters for use herein include, but are not necessarily limited to the teachings of U.S. Pat. No. 4,491,452, titled "Load Transporting Apparatus," issued on Jan. 1, 1985; U.S. Pat. No. 3,697,032 titled "Scaffolding," issued on Oct. 10, 1972; U.S. Pat. No. 7,228,936 titled "Mobile Scaffolding Braking System," issued on Jun. 12, 2007; and U.S. Pat. No. 2,618,496 titled "Adjustable Supporter Leg," issued on Nov. 18, 1952; U.S. Patent Publication No. 20060103094, titled "Pallet Cart," published on May 18, 2006; and U.S. Pat. No. 4,281,843, titled "Tool Carrier," issued on Aug. 4, 1981; each of which is herein incorporated by reference in its entirety.

The system 10, or first module 100 alone, may also be operationally configured to be made level when located upon an uneven support surface. In one simplified embodiment including a system 10 as shown in FIG. 1 including a base surface 106 resting against a support surface 17, one or more durable leveling members may be placed underneath the framework 105 at one or more locations as desired in order to level a first module 100 or the system 10 when located on an uneven support surface 17. Suitable leveling members may include, but are not necessarily limited to planar structures and/or wedges constructed from metal, wood, plastic, rubber, stone, and combinations thereof effective for supporting the weight of a first module 100 or system 10. Non-limiting examples of leveling members for use herein are described in U.S. Pat. No. 5,249,767, titled "Table Leveling Wedge" issued on Oct. 5, 1993; U.S. Pat. No. 4,776,548, titled "Leveling Device" issued on Oct. 11, 1988; and U.S. Pat. No. 6,793,041, titled "Ladder Leveling Device," issued on Sep. 21, 2004; each of which is herein incorporated by reference in its entirety.

In another embodiment, the base surface 106 of the framework 105 may include one or more adjustable levelers operationally configured to level the first module 100 or system 10. Non-limiting examples of levelers for use herein are described in U.S. Pat. No. 5,881,979, titled "Telescoping Leveler," issued on Mar. 16, 1999; and U.S. Pat. No. 2,010,299, titled "Table Leveler," issued on Aug. 6, 1935; each of which is herein incorporated by reference in its entirety. As understood by persons of ordinary skill in the art, telescoping type levelers are operationally configured to adjust or vary the height of the system 10. In another embodiment, the system 10 may include a separate base member with built in leveling operation and/or wheels for transport. Non-limiting examples of base members for use herein are described in U.S. Pat. No. 4,216,933, titled "Portable Scaffold Support Base," issued on Aug. 12, 1980; and U.S. Pat. No. 5,022,490, titled "Safety Base for Scaffolding," issued on Jun. 11, 1991; each of which is herein incorporated by reference in its entirety.

With further reference to FIG. 9, a framework 205 may be provided as an open frame configuration for securing one or more dry additive storage containers 206 therein as shown. In another embodiment, one or more dry additive storage containers 206 may be housed within a framework comprised of a walled enclosure or assembly of walled members operationally configured to enclose one or more dry additive storage containers 206. Without limiting the invention, a suitable storage container 206 may include a storage tank, storage bin, and the like effective for housing one or more dry additives therein while preventing or otherwise minimizing exposure of the one or more dry additives to moisture and/or the external environment.

Figure 16:
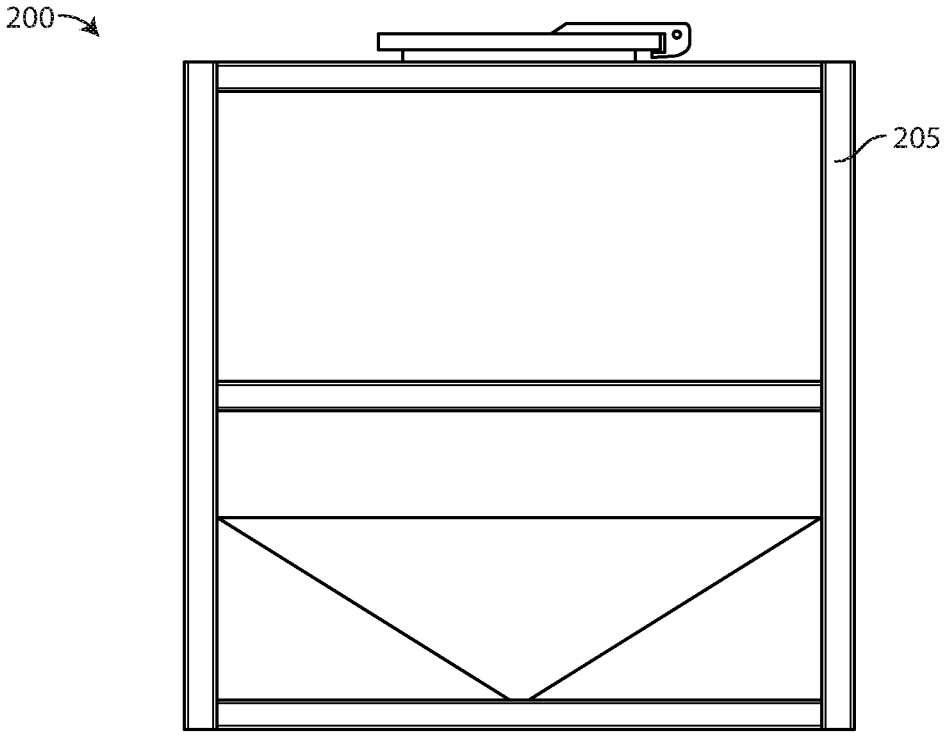
FIG. 16 is a side view of an embodiment of a second module.
Figure 17:
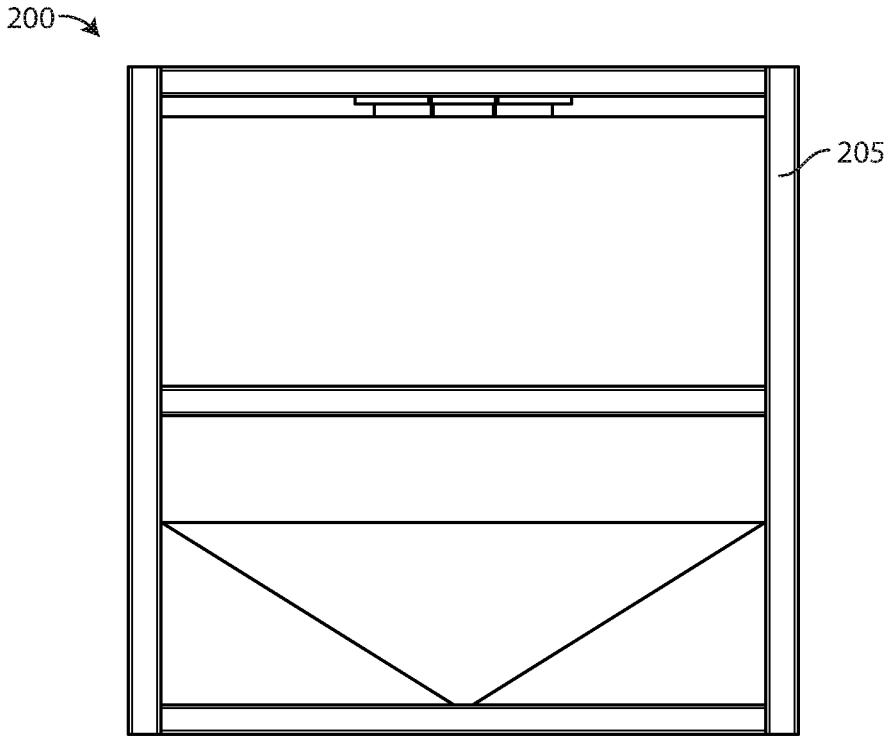
FIG. 17 is a side view of an embodiment of a second module.
Figure 18:
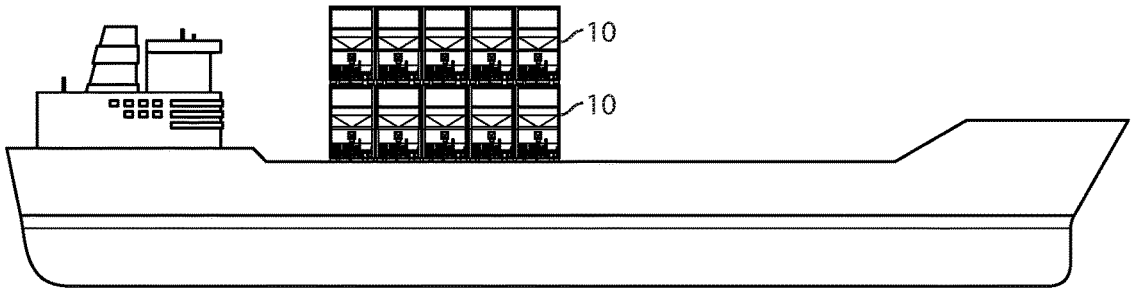
FIG. 18 is an illustration of multiple assembled systems in a stacked arrangement on the deck of a ship.
Figure 19:
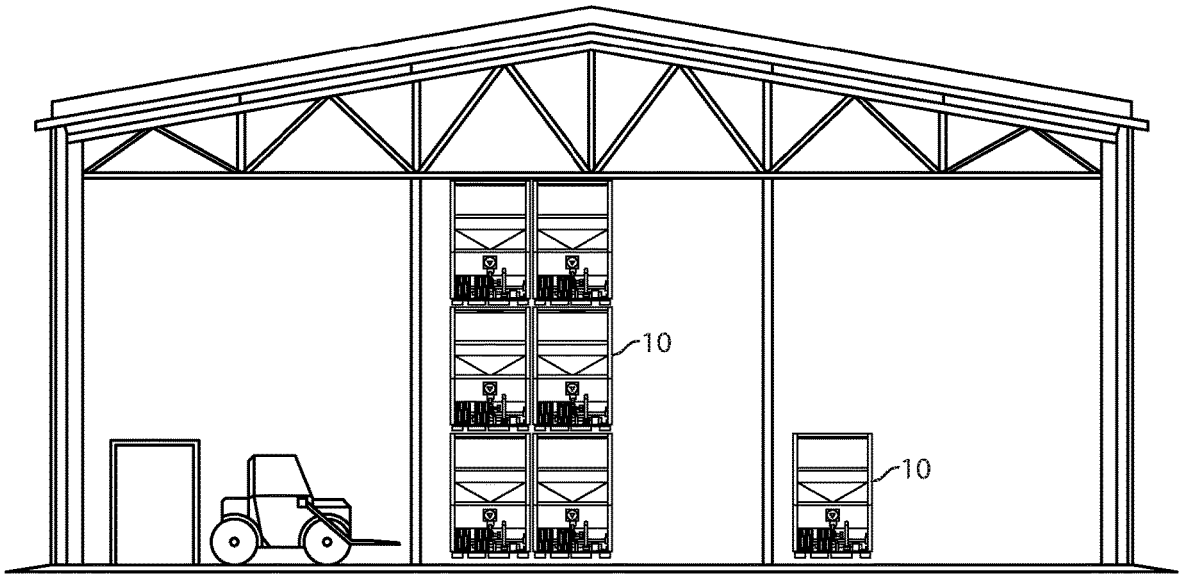
FIG. 19 is an illustration of multiple assembled systems in a stacked arrangement in a warehouse.

With reference to FIG. 16, the framework 205 may be sized to secure substantially all of the one or more dry additive storage containers 206 within the boundary of the framework 205. In another embodiment, the framework 205 may be sized to secure the one or more dry additive storage containers 206 entirely within the boundary of the framework 205 as depicted in FIG. 17. In an embodiment of the system 10 incorporating a second module 200 as shown in FIG. 17, the system 10 may be stacked for transportation and/or storage as shown in FIGS. 18 and 19. Also, systems 10 may be stacked during operation as desired or as otherwise may be required at a location with limited space. As such, the stackability of systems 10 is advantageous for minimizing the mixing operation footprint at various worksites. The framework 205 as depicted in FIG. 16 may also be stackable depending on the configuration of the base surface 106 of the framework 105.

Figure 7:
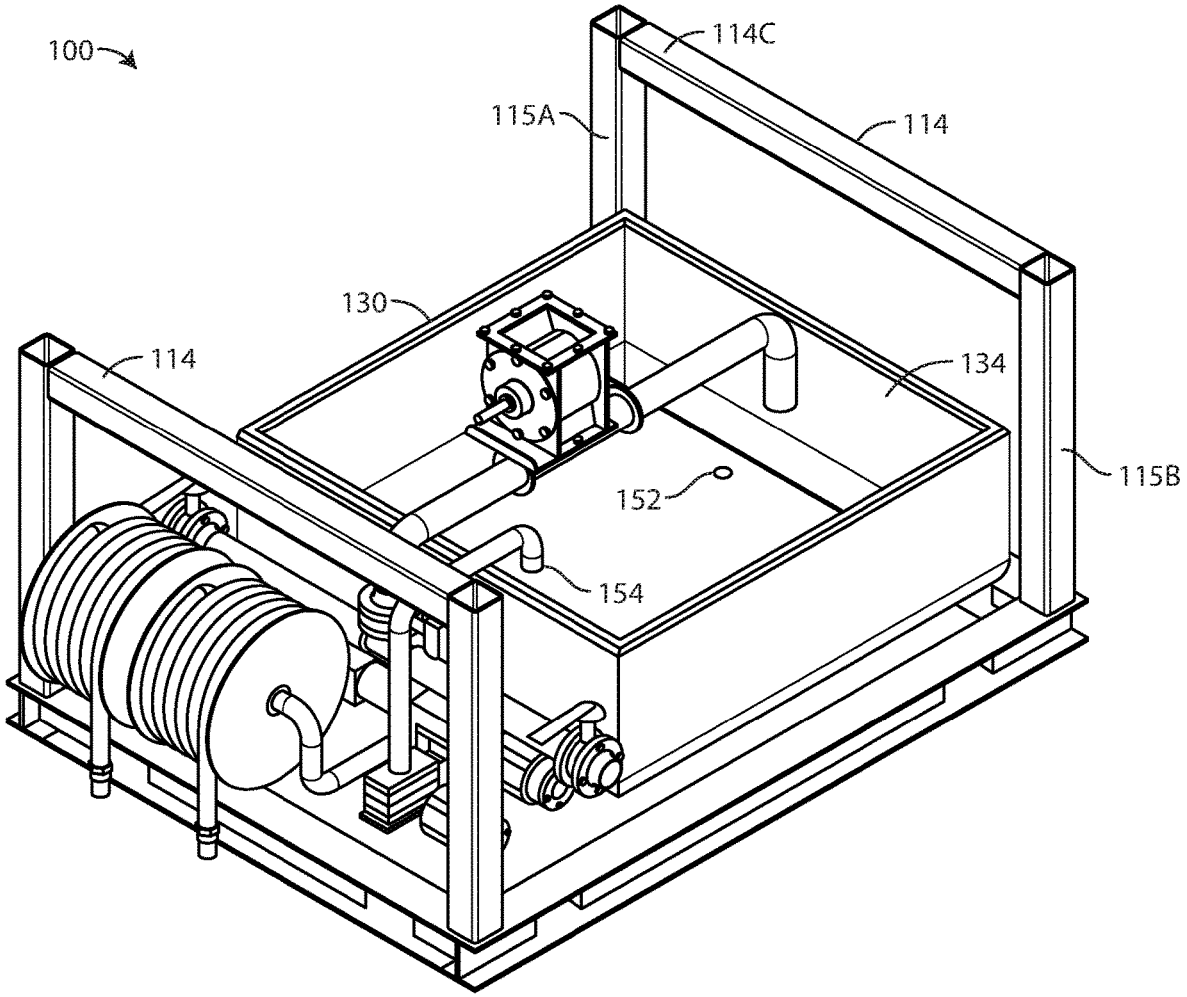
FIG. 7 is a perspective view of another embodiment of a first module.
Figure 8:
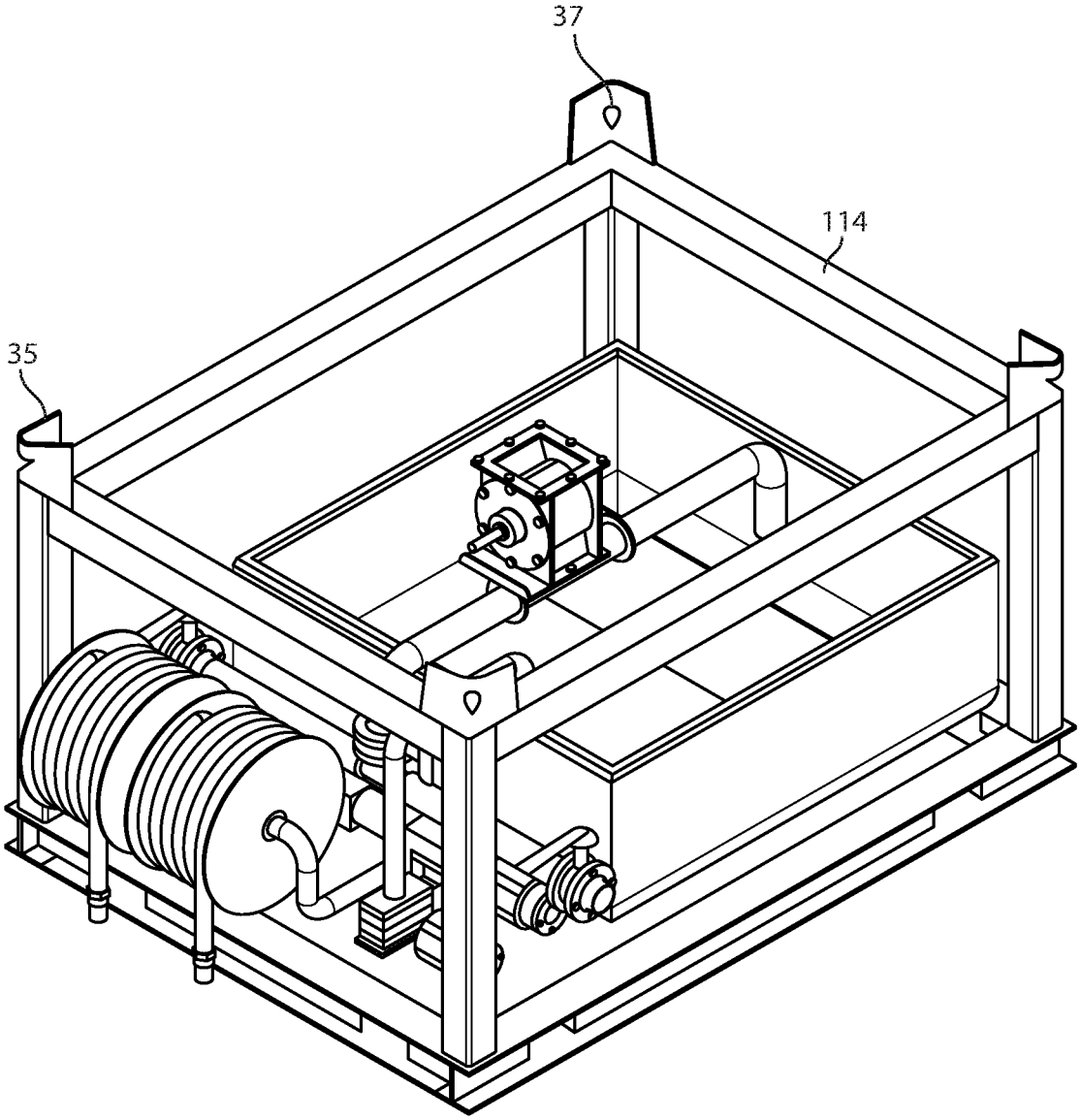
FIG. 8 is a perspective view of another embodiment of a first module.

As shown in FIGS. 6 and 7, the one or more vertical members 115 and the raised horizontal rail type support members 114 are suitably located along the perimeter of the framework 105 in a manner effective to enclose the various component parts and/or equipment of the first module 100. Suitable first module 100 component parts and/or equipment include mechanical and/or structural items operationally configured for receiving fluid from one or more external sources, receiving dry additive from a second module 200 and/or one or more external sources, mixing fluid and dry additive to produce fluid mixture compositions and conveying fluid mixture compositions out from the first module 100 to one or more target locations and/or containers.

The materials of construction of (1) the frameworks 105, 205, (2) the one or more vertical members 115 and (3) the raised horizontal rail type support members 114 and male type vertical members 223 are operationally configured to provide structural integrity of the first and second modules 100, 200 during system 10 operation. Suitable materials of construction of each may include, but are not necessarily limited to plastics, woods, metals, composite materials, and combinations thereof. Suitable metals include, but are not necessarily limited to stainless steel, mild steel, aluminum, and combinations thereof.

With reference to FIG. 7, in one embodiment the first module 100 may include at least one open top single basin container, tub or vat (hereafter "mixing tub 130") of a desired maximum volume for receiving, storing and mixing one or more fluids and/or one or more dry additives therein. In another embodiment a single mixing tub 130 may include two or more separate basins for receiving fluid and/or receiving dry additive for storage and/or mixing purposes. In another embodiment, two or more single basin mixing tubs 130 may be employed to provide multiple basins of the system 10. Of note, the present system 10 may be built to scale, as such a mixing tub 130 may be provided with one or more basins of particular maximum volumes effective to hold desired or required volumes of fluid mixture compositions during system 10 operation. In other words, the system 10 may be modeled mathematically to produce one or more predetermined fluid mixture compositions. Also, the total weight of the present system 10 may vary according to the size of the system 10, the one or more materials of construction and the amount of each such material(s) present, e.g., the wall thickness of the mixing tub 130, the thickness of the frameworks 105, 205 and the size and/or type of components and/or equipment employed.

Figure 20:
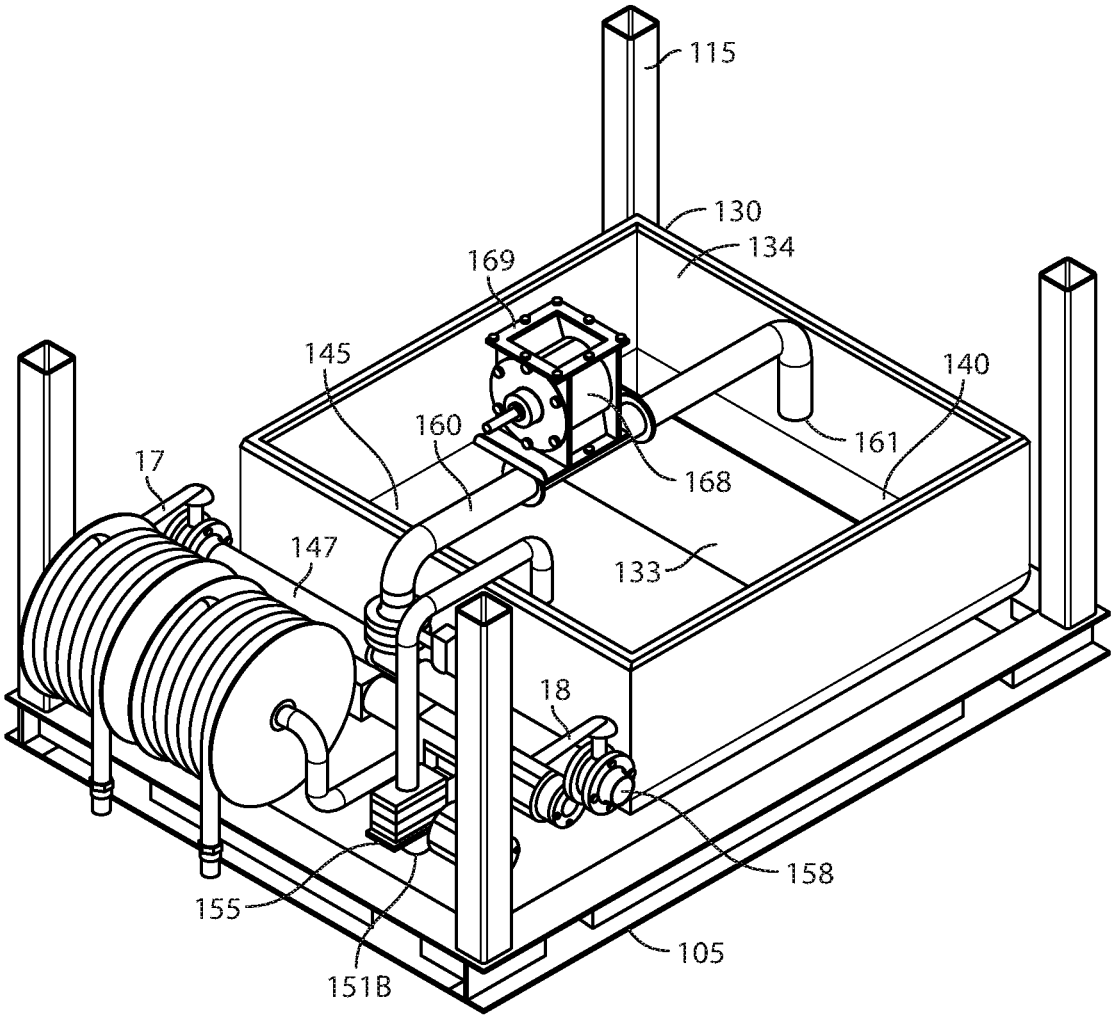
FIG. 20 is a perspective view of an embodiment of a first module.
Figure 21:
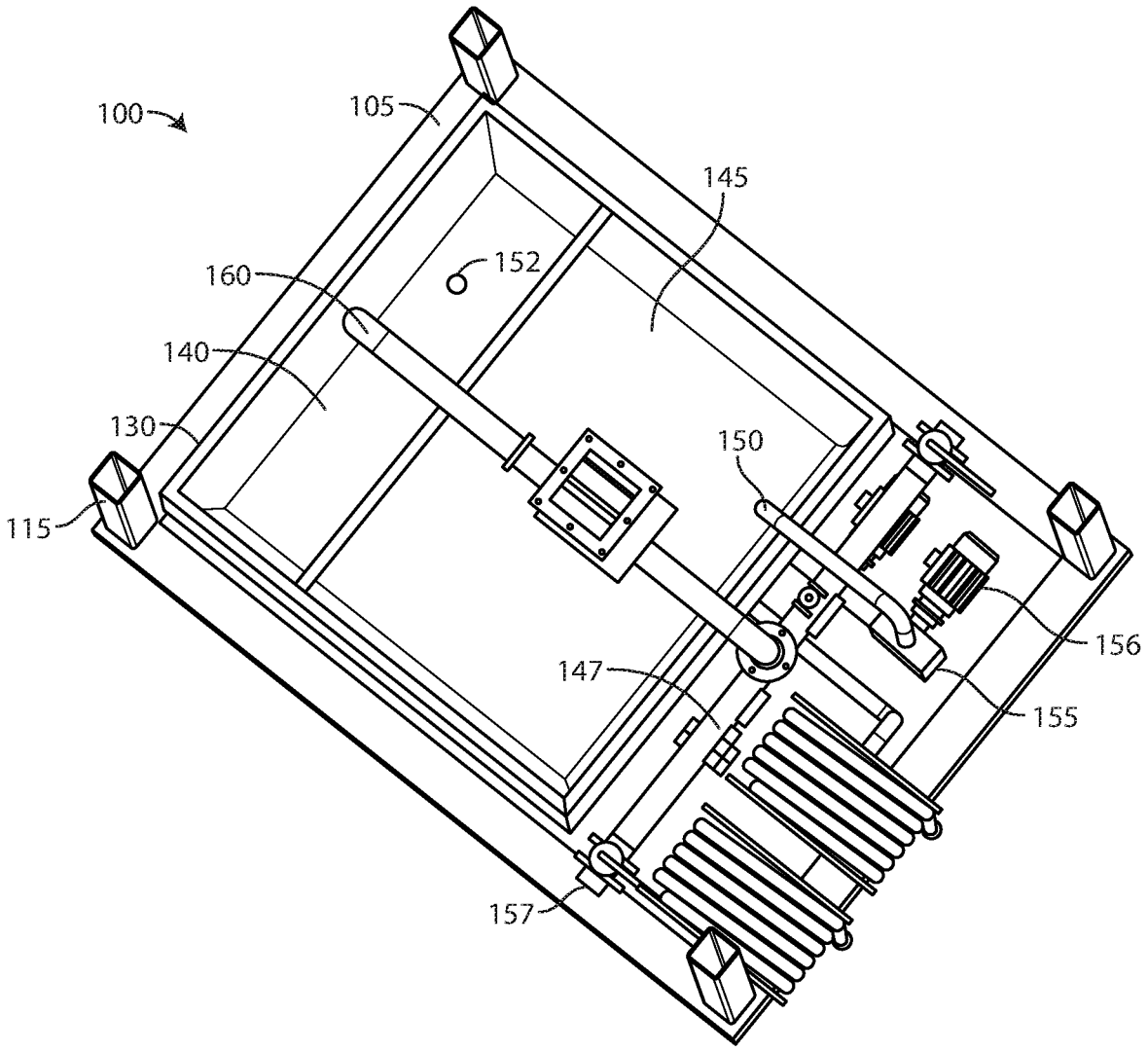
FIG. 21 is a perspective view of an embodiment of a first module.
Figure 22:
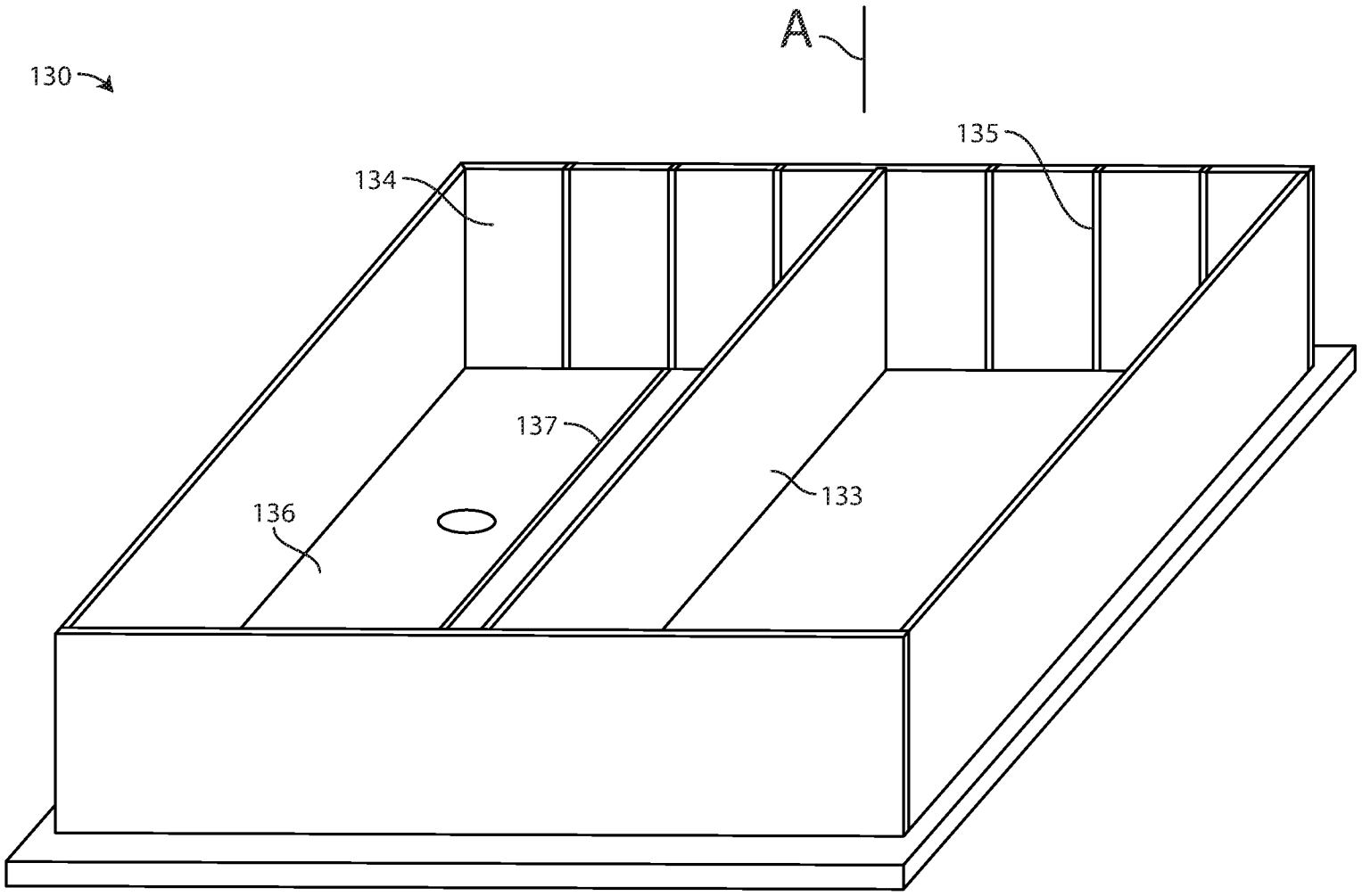
FIG. 22 is a perspective view of an embodiment of a mixing tub of the first module.
Figure 23:
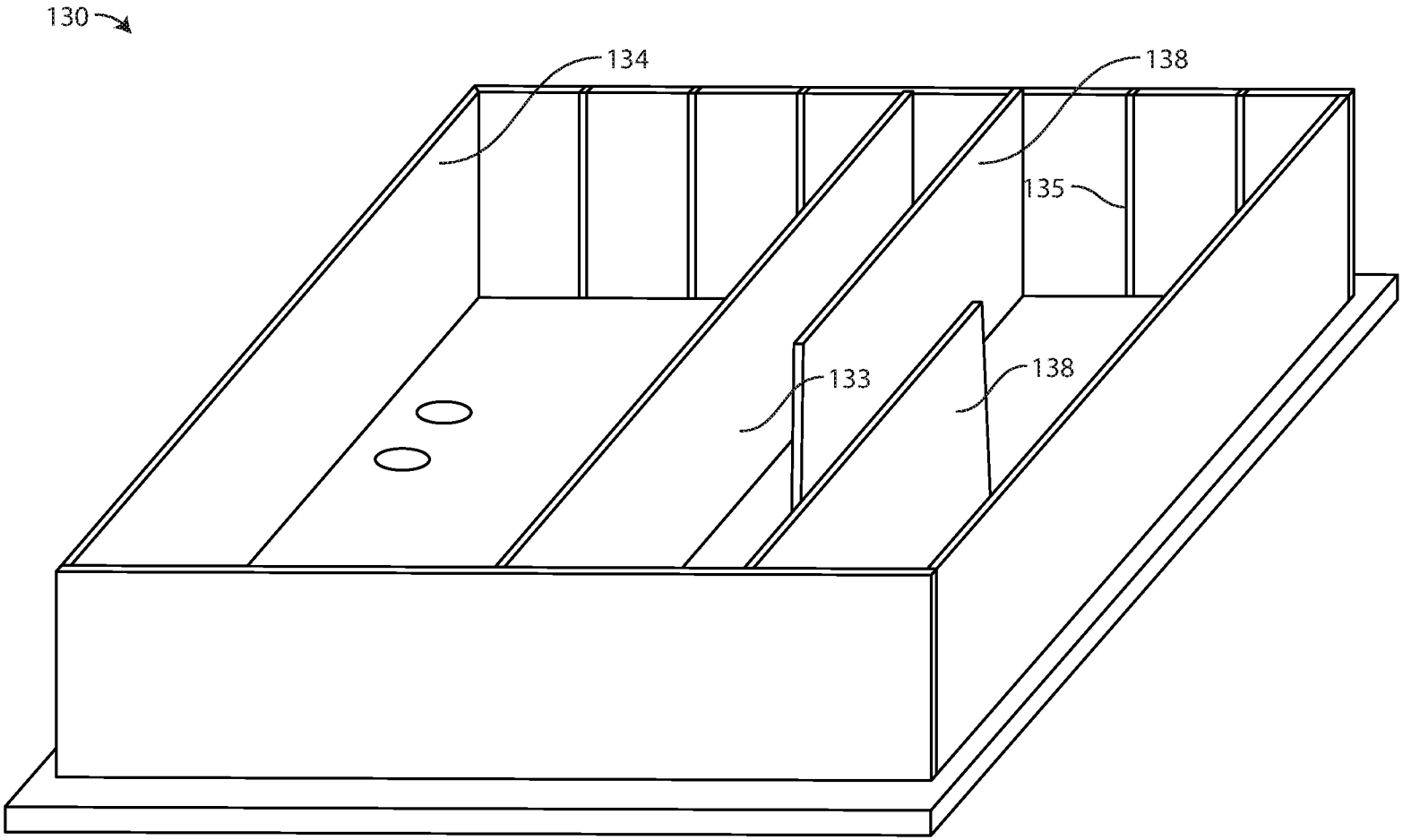
FIG. 23 is a perspective view of another embodiment of a mixing tub.

Turning to FIGS. 20 and 21, in one suitable embodiment a mixing tub 130 may be divided into individual basins via one or more wall members or dividers 133 of permanent installation or removable installation. For example, a mixing tub 130 of a known maximum volume may include a permanent divider 133 effective to provide individual basins of the same or different maximum volumes according to the layout, shape and/or position of the divider 133. For example, a divider 133 may include a planar member as shown or a curved member or other shape as desired. Turning to FIG. 22, in an embodiment comprising a removable divider 133 one suitable mixing tub 130 may include perimeter wall members or sidewalls 134 with a plurality of vertically spaced channels 135 disposed thereon for adjusting the location of the divider 133 by inserting and removing the divider 133 according to Directional Arrow A—the channels 135 allowing for the volume of individual basins to be adjusted as desired for one or more particular system 10 operations. Suitably, the channels 135 are located along opposite sidewalls 134 at a depth effective to receive a portion of the distal ends of the divider 133 therein in a manner to prevent fluid flow around the distal ends. In addition, the mixing tub 130 may also include corresponding channels 137 on the floor 136 of the mixing tub 130 that are set at a depth operationally configured to receive a portion of the bottom edge of a divider 133 therein in a manner effective to prevent fluid from flowing under the divider 133. It is further contemplated that the mixing tub of FIG. 22 may include two or more removable dividers 133 in a particular operation. In another embodiment, one or more baffles 138 may be disposed in one or more basins in a manner effective to dictate and/or control the directional flow of fluid as desired, e.g., a serpentine flow path as shown in FIG. 23. Similar as the one or more dividers 133, one or more baffles 138 may be permanently attached or removably attached to a mixing tub 130. As understood by the skilled artisan, the channels 135, 137 and/or the opposing ends and bottom edge of removable dividers 133 and removable baffles 138 may include gasket material and/or other sealing materials and/or fluid sealing materials, e.g., liquid rubber, silicone sealants, effective to prevent the flow of fluid between adjacent basins around the ends or under the bottom edge of the divider(s) 133.

A mixing tub 130 of this application may include sidewalls 134 of desired height defining a perimeter shape similar as, or different from, the perimeter of the corresponding framework 105. For example, a first module 100 may include a rectangular framework 105 and a rectangular mixing tub 130 as shown in FIGS. 20 and 21, where the length of the perimeter of the mixing tub 130 is less than the perimeter of the framework 105. In this particular embodiment, the mixing tub 130 includes two separate basins, a first basin 140 and a second basin 145 defined by a divider 133. As understood by the skilled artisan, the location of the divider 133 in addition to its size configuration, e.g., the height and/or thickness of the divider 133 and the height of the sidewalls 134 determines the maximum volume of the first and second basins 140, 145 whereas the maximum volume of the mixing tub 130 is determined according to the dimensions of the mixing tub 130 less the size of the one or more dividers 133 and/or one or more baffles 138 employed. As stated, the system 10 may be built to scale. As such, in one non-limiting example of a system 10 operationally configured for oil and gas extraction operations, a suitable first basin 140 may include a maximum volume of about 358.0 liters (about 3.0 barrels) and a second basin 145 may include a maximum volume of about 835.0 liters (about 7.0 barrels).

As discussed below, the height of the sidewalls 134 is suitably greater than the height of the divider 133 allowing fluid to flow from the first basin 140 to the second basin 145 over the divider 133 once the volume of fluid directed into the first basin 140 is greater than the fluid volume of the first basin 140. Depending on the intended operation of the system 10, the height and/or thickness of the divider 133 in relation to the height of the sidewalls 134 may vary, which varies the volume of the first and second basins 140, 145. In an embodiment including removable dividers 133, dividers 133 of varying height and/or thickness may be interchanged as desired or as otherwise required for one or more particular system 10 operations. Without limiting the invention, one suitable divider 133 may include a height from about 0.1 to about 0.95 percent the height of the corresponding sidewalls 134. As depicted in the embodiment of FIGS. 20 and 21, a suitable divider 133 may include a height of or about 0.75 percent the height of the sidewalls 134. Likewise, baffles 138 used herein may include a height less than, greater than or equal to the height of corresponding sidewalls 134.

A mixing tub 130, dividers 133 and baffles 138 of this application may be constructed from one or more materials durable for one or more system 10 operations and/or as may be required by law or regulation. Suitable materials of construction may include, but are not necessarily limited to those materials resistant to chipping, cracking, excessive bending and reshaping as a result of ozone, weathering, heat, moisture, other outside mechanical and chemical influences, as well as impacts. In particular, a mixing tub 130 of this application may be constructed from materials including, but not necessarily limited to metals, plastics, fiberglass, plexiglass, filled composite materials, and combinations thereof. In an embodiment of a system 10 operationally configured for oil and gas related hydraulic fracturing operations, a mixing tub 130 is suitably constructed from one or more metals. Suitable metals include, but are not necessarily limited to stainless steel, mild steel, aluminum, and combinations thereof. Metals such as titanium are contemplated but may not be feasible based on material cost.

Figure 24:
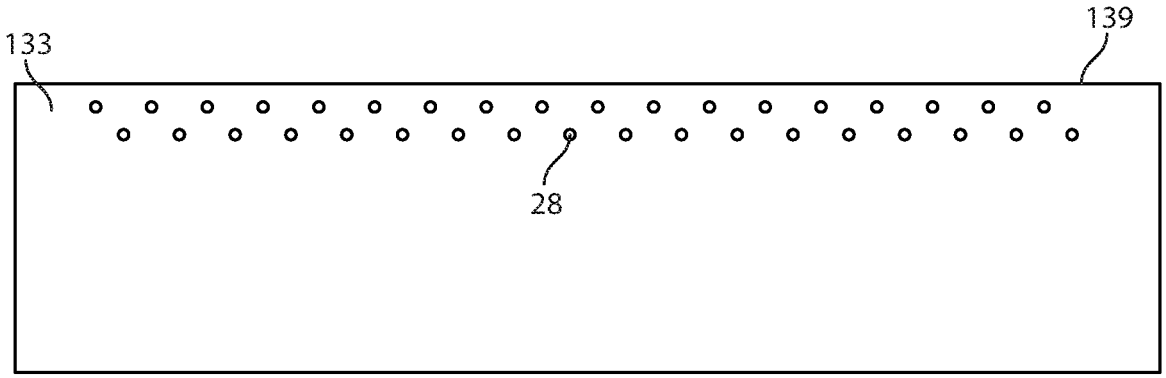
FIG. 24 is a front elevation view of an embodiment of a divider of a mixing tub.
Figure 25:
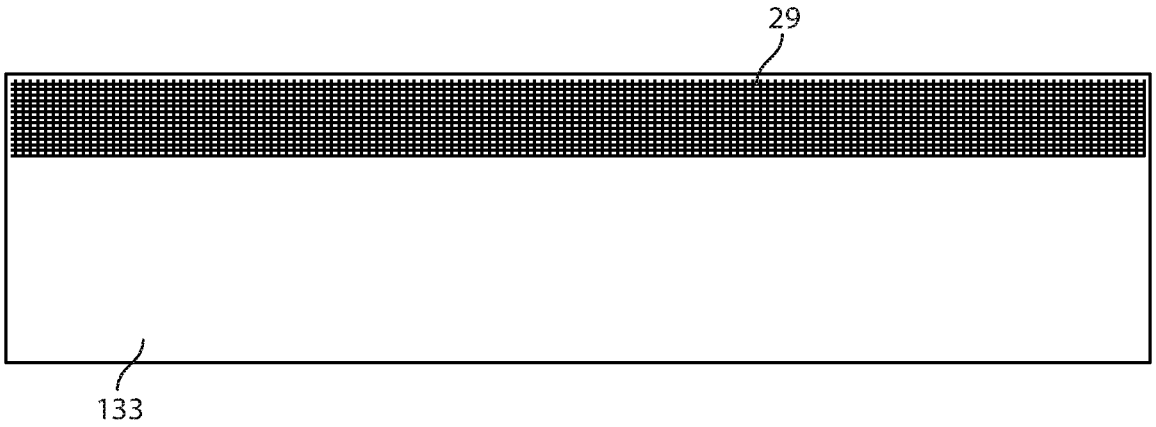
FIG. 25 is a front elevation view of another embodiment of a divider.

In another embodiment, one or more dividers 133 may include apertures 28 there through operationally configured to allow fluid to flow from a first basin 140 to an adjacent second basin 145—see FIG. 24 depicting a plurality of apertures 28 disposed near the upper edge 139 of the divider 133. In still another embodiment, one or more dividers 133 may include one or more screen members 29, e.g., mesh screen material or the like, defining the upper section of the divider 133 or located near the upper edge 139 of a divider 133 as shown in the simplified embodiment of FIG. 25. In another embodiment, one or more dividers 133 may include a combination of one or more apertures 28 and one or more screen members 29. As described below, the one or more apertures 28 and/or one or more screen members 29 may influence mixing of the fluid mixture composition during transfer from the first basin 140 to the second basin 145. Also, the one or more apertures 28 and/or one or more screen members 29 may be operationally configured to filter or trap certain sized solids from flowing into the second basin 145.

Although the apertures 28 of FIG. 24 are shown as circular through holes aligned in multiple rows and having a uniform size relative the size of the divider 133, other uniform or non-uniform shape and size apertures 28 may be disposed in one or more arrangements or arrays along a divider 133. For operations such as the on-site extraction of oil and gas, apertures 28 may range in size from about 2.0 mm to about 50.0 mm (about 0.0787 inches to about 1.96 inches). Likewise, the United States ("U.S.") mesh size of one or more screen members 29 may vary as desired for a particular operation. For operations such as the on-site extraction of oil and gas, a mesh range as shown in the Table 1 ("Mesh to Micron Conversion" table) below may be employed, although other mesh sizes may be used. For factory based food processing operations, a suitable mesh range may be from about U.S. standard 30-mesh to about 80-mesh.

TABLE 1

| U.S. Mesh Size | Inches | Microns | Millimeters |
|---|---|---|---|
| 3 | 0.2650 | 6730 | 6.730 |
| 4 | 0.1870 | 4760 | 4.760 |
| 5 | 0.1570 | 4000 | 4.000 |
| 6 | 0.1320 | 3360 | 3.360 |
| 7 | 0.1110 | 2830 | 2.830 |
| 8 | 0.0937 | 2380 | 2.380 |
| 10 | 0.0787 | 2000 | 2.000 |
| 12 | 0.0661 | 1680 | 1.680 |
| 14 | 0.0555 | 1410 | 1.410 |
| 16 | 0.0469 | 1190 | 1.190 |
| 18 | 0.0394 | 1000 | 1.000 |
| 20 | 0.0331 | 841 | 0.841 |
| 25 | 0.0280 | 707 | 0.707 |
| 30 | 0.0232 | 595 | 0.595 |
| 35 | 0.0197 | 500 | 0.500 |

In a first mode, the first and second basins 140, 145 are fluidly communicated within the mixing tub 130. Said another way, fluid flow between the first and second basins 140, 145 may be confined within the mixing tub 130 via the flow of fluid over the divider 133 and/or through the one or more apertures 28 and/or screen members 29 from the first basin 140 to the second basin 145. Such fluid flow between basins 140, 145 may be referred to herein as "internal fluid transfer." Such fluid flow between basins 140, 145 may also be referred to herein as "spillover fluid transfer."

In another mode, the first and second basins 140, 145 may be fluidly communicated via one or more conduits external of the mixing tub 130. For example, the first module 100 may include one or more conduits (1) in fluid communication with the first basin 140 at a first end and (2) in fluid communication with the second basin 145 at an opposing second end of the one or more conduits. In one suitable embodiment, the first module 100 may include one or more pumps in fluid communication with the one or more conduits for directing fluid from the first basin 140 to the second basin 145 via the one or more conduits. Such fluid flow between basins 140, 145 may be referred to herein as "external fluid transfer." Such fluid flow between basins 140, 145 may also be referred to herein as "pumped fluid transfer." Such fluid flow between basins 140, 145 may also be referred to herein as "shear mixing fluid transfer" as discussed below.

Figure 29:
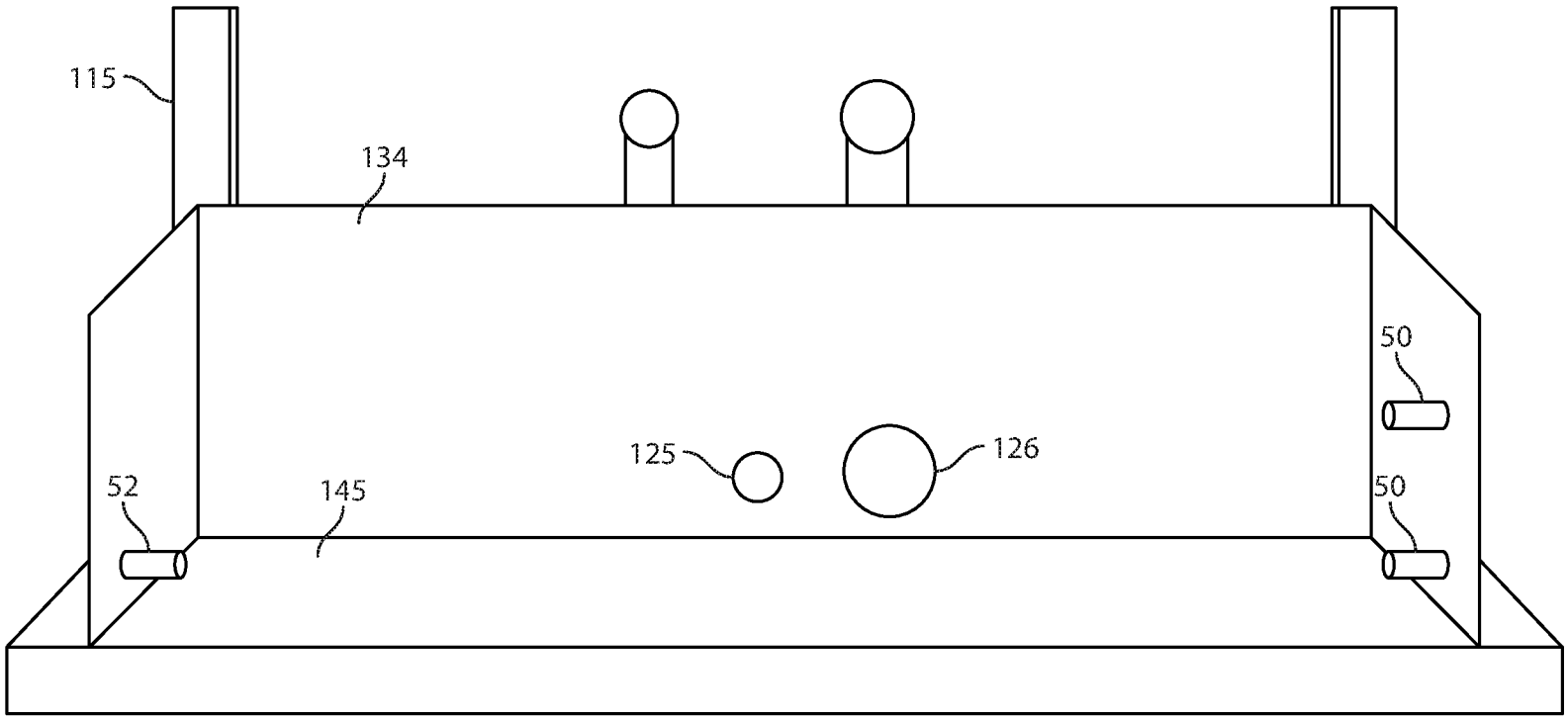
FIG. 29 is a perspective sectional view of a second basin of a mixing tub.

In order to monitor and/or control the fluid volume of the mixing tub 130, the first and second basins 140, 145 may include one or more fluid volume or fluid level sensors 50 installed within the basins 140, 145 for monitoring the fluid level of each basin 140, 145 during system 10 operation (see FIG. 29). In one embodiment, one or more fluid level sensors 50 may be secured to one or more sidewalls 134 and/or one or more dividers 133. In another embodiment, one or more fluid level sensors 50 may be installed as part of a removable sensor system. Suitable fluid level sensors 50 include, but are not necessarily limited to float-type switches, hydroelectric switches, pressure sensors/probes, and fluid level sensors/probes. In a similar manner, the first basin 140 and/or the second basin 145 may also include one or more temperature sensors 52 operationally configured to monitor the temperature of fluid within the mixing tub 130. Suitable temperature sensors 52 include, but are not necessarily limited to temperature switches, digital temperature switches or transmitters, thermocouple sensors, thermocouple probes, resistance temperature detectors ("RTD") PT100 sensors and probes, temperature transmitters with an integral sensor, temperature transmitters with thermocouple input, temperature transmitters with an RTD input, programmable temperature transmitters with RTD or a thermocouple input, thermowells for RTDs, thermocouples, thermometers, thermocouple extension wire, RTD extension wire, and combinations thereof.

For proper sensor operation, the first module 100 suitably includes one or more electrical connections between the fluid level sensors 50, temperature sensors 52 and a process control system described below. As understood by the skilled artisan, suitable electrical connections include, but are not necessarily limited to electrical plugs, quick connects and hardwire techniques such as wire splices, soldered connections, and crimp splices. For example, in one embodiment, one or more sidewalls 134 of the first and second basins 140, 145 may include one or more wiring access ports 54 for receiving the electrical connections of the system 10 for sensor operation (see FIG. 26).

Figure 26:
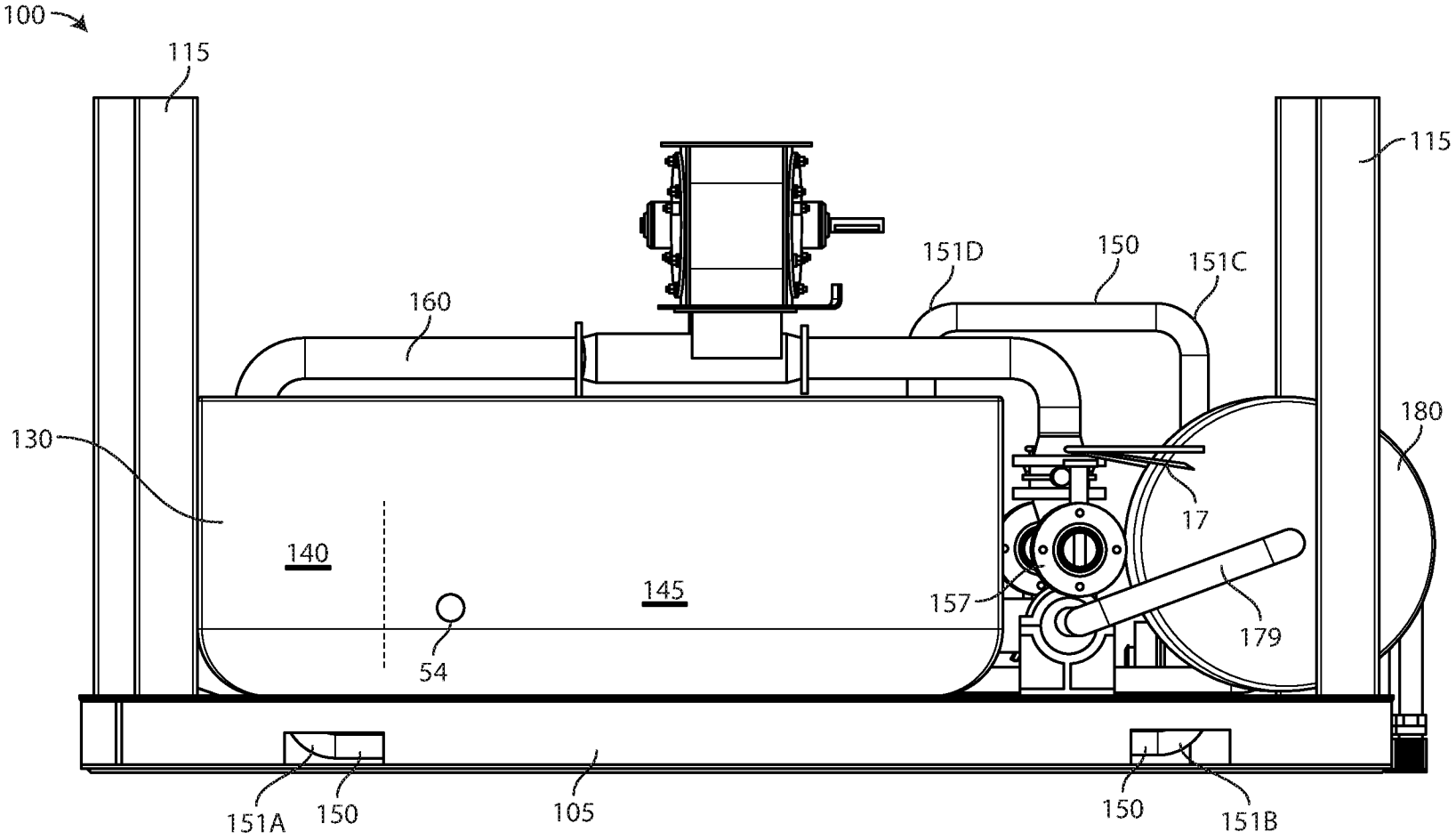
FIG. 26 is another view of a first module.

As shown in the embodiment of FIG. 26, for providing external fluid transfer the first module 100 may include a mixing tub conduit 150 (also referred to herein as a "bypass line") having a first end in fluid communication with a first basin 140 and a second end in fluid communication with the second basin 145. In particular, the mixing tub conduit 150 may include at least a first bend 151A or turn whereby part of the mixing tub conduit 150 extends upward for attachment to an outlet 152 or drain located in the floor 136 of the first basin 140. As such, the first support surface 108 suitably includes a first opening effective for the mixing tub conduit 150 to extend there through for fluid communication with an outlet 152. As further shown in FIG. 26, the remaining mixing tub conduit 150 extends to a point out beyond the perimeter of the mixing tub 130 in a manner effective for the an opposing second end 154 of the mixing tub conduit 150 to feed the second basin 145 with fluid originating in the first basin 140. In one embodiment, the section of the mixing tub conduit 150 extending out beyond the perimeter of the mixing tub 130 may include a "C-shape" or the like effective to dispense fluid originating in the first basin 140 into the second basin 145. As shown in FIG. 26, the conduit 150 may include three ninety-degree bends 151B, 151C and 151D effective for positioning an open second end 154 of the mixing tub conduit 150 at point above the second basin 145. In one embodiment, the second end 154 of the conduit 150 may extend down into the mixing tub 130 as shown in FIGS. 20 and 21. In another embodiment, the second end 154 of the mixing tub conduit 150 may terminate at a point above the sidewalls 134 of the mixing tub 130 as shown in FIG. 7. Similar as mentioned above, the first support surface 108 suitably includes a second opening effective for receiving a section of the mixing tub conduit 150 there through.

The length of the mixing tub conduit 150 may vary as desired or as otherwise required. As understood by the skilled artisan, a minimum length of mixing tub conduit 150 may be accomplished by providing a linear mixing tub conduit 150 bending in-line as shown in FIG. 21, for example, see the location of the outlet 152 in the first basin 140 and the second end 154, as well as minimizing the distance the mixing tub conduit 150 extends out beyond the perimeter of the mixing tub 130.

With further reference to FIG. 21, the first module 100 may include a first pump 155 in fluid communication with the first basin 140 via the mixing tub conduit 150. Suitably, the first pump 155 is operationally configured to direct fluid out from the first basin 140 through the mixing tub conduit 150, through the first pump 155 and out through the second end 154 of the mixing tub conduit 150 into the second basin 145. As described below, where the fluid in the first basin 140 includes a fluid mixture composition, the first pump 155 may be operationally configured to act on the fluid flowing there through in a manner effective to modify the fluid mixture composition. As discussed below, a suitable first pump 155 is operationally configured to mix and/or shear the fluid mixture composition received from the first basin 140. One suitable first pump 155 may include a conditioning pump. Another suitable first pump 155 may include a shear mixer. A suitable conditioning pump is commercially available from SPX FLOW, Inc., Charlotte, N.C., U.S.A. under the brand Waukesha Cherry-Burrell. A suitable shear mixer is commercially available from SPX FLOW, Inc., Charlotte, N.C., U.S.A. under the brand Waukesha Cherry-Burrell.

Referring to FIG. 20, a ninety-degree bend 151B may be effective to direct the mixing tub conduit 150 directly into an inlet of the first pump 155. In another embodiment, a first pump 155 may be provided with an inlet 38 for side entry of fluid (see FIG. 27) thereby requiring a different arrangement of the mixing tub conduit 150 for feeding fluid into the first pump 155.

Figure 27:
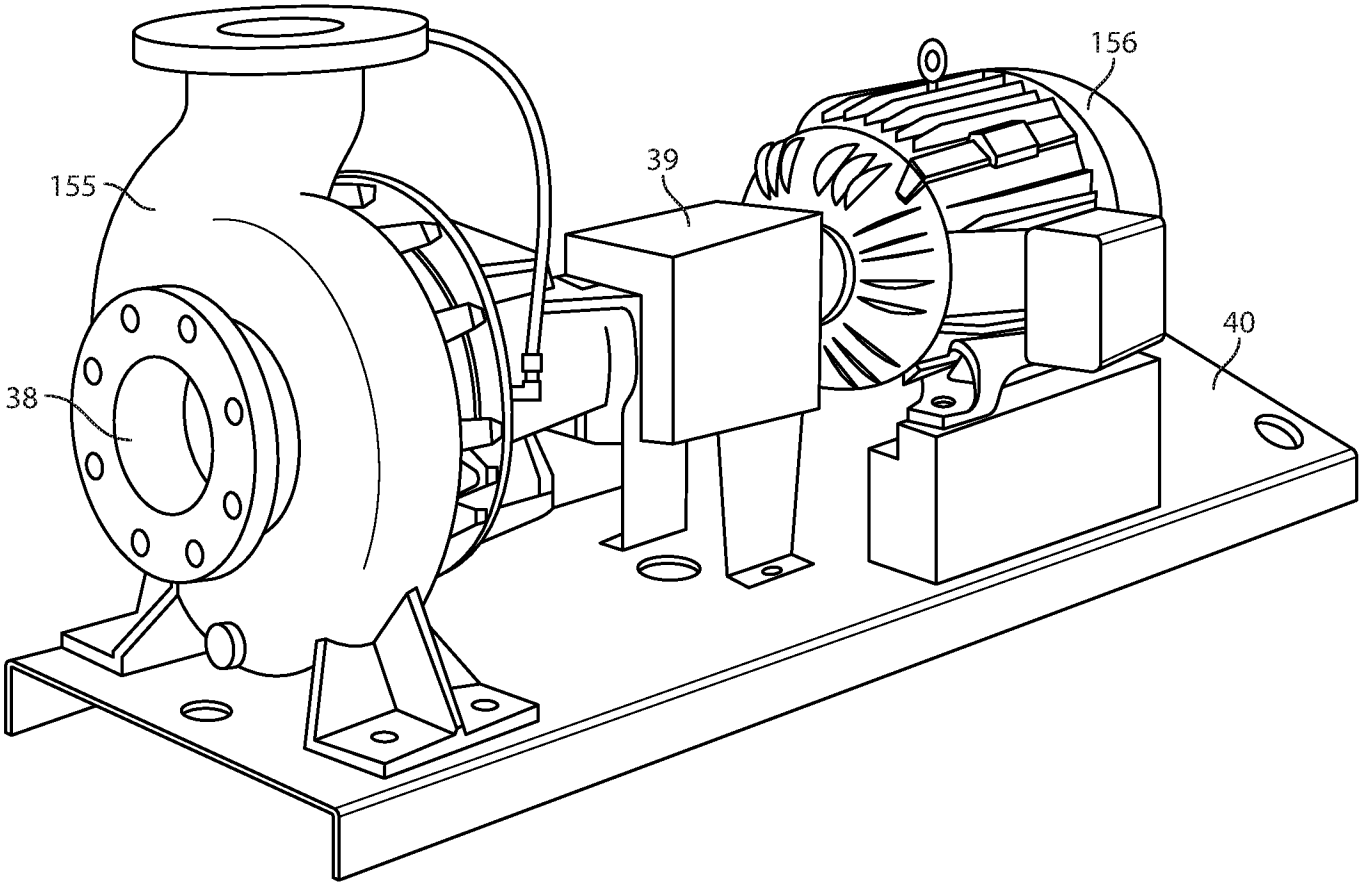
FIG. 27 is an in-line pump and power source set upon a removable support for attachment to a first module.

The first pump 155 may be electrically driven, hydraulically driven, or direct driven from one or more external power sources. As shown in FIG. 21, the first module 100 may include a power source 156 located on the base support of the first module 100 operationally configured to power the first pump 155. Suitable power sources 156 include, but are not necessarily limited to electric induction motors, hydraulic drive motors, and pneumatic drive motors. As understood by persons of ordinary skill in the art of pumps, a first pump 155 and power source 156 may be connected in-line aligning the shafts for operation. As understood by persons of ordinary skill in the art of pumps, a power source 156 may also be operably communicated with a first pump 155 via a coupler 39 or "coupler box" as shown in FIG. 27. In addition, rather than fixing the first pump 155 and/or power source 156 directly to first support surface 108 of the first module 100, a first pump 155 and power source 156 may be provided on a removable support 40 (see FIG. 27) for mounting to the first support surface 108 of the first module 100.

The flow rate of the fluid mixture composition flowing through the mixing tub conduit 150 may be metered by one or more flow meters including, but not necessarily limited to, electromagnetic flow meters. Suitable flow meters may be positioned at any point along the mixing tub conduit 150, including a vertical or horizontal section of the mixing tub conduit 150. As such, the system 10 is operationally configured to adjust the flow rate of fluid mixture compositions being fed into the second basin 145 by adjusting the speed of the first pump 155, for example, if the metered flow rate within the mixing tub conduit 150 is not as programmed.

Although it is contemplated that fluid and dry additive may be fed directly to the second basin 145 thereby bypassing the first basin 140, herein the mixing of fluid and dry additive via the system 10 is discussed in terms of a first basin 140 being the initial basin for receiving fluid to be used by the system 10. As such, in one embodiment an external hose or other conduit may be used to feed fluid directly into the first basin 140. In another embodiment, fluid may be fed into the first basin 140 by emptying one or more containers of fluid directly into the first basin 140 via pouring or via one or more container spigots. As discussed below, the first module 100 includes an assembly of fluid lines for delivering fluid from one or more external sources directly to the first basin 140.

In order to provide fluid for system 10 operation, the system 10 suitably includes at least one main supply line (hereafter "main line 147") in the form of a conduit operationally configured to receive supply fluid from one or more external sources via one or more fluid conduits for system 10 operation. As depicted in FIGS. 20, 21 and 26, the main line 147 is provided as a conduit with at least a first fluid inlet 157 at one end and a first fluid outlet 158 at an opposing second end. As shown, the first fluid inlet 157 is located near an edge of one side of the framework 105 and the first fluid outlet 158 is located near an edge of an opposing side of the framework 105. However, the main line 147 may be configured along the first module 100 in a different arrangement as desired or as may be otherwise required for one or more particular system 10 operations.

In one embodiment, fluid may be directed to the first fluid inlet 157 under pressure via gravity, e.g., a water tower or a fluid storage container located at a higher elevation than the first fluid inlet 157. In another embodiment, fluid may be directed to the first fluid inlet 157 via one or more fluid transfer pumps located external the system 10 and/or provided as part of the first module 100. Suitable fluid transfer pumps include positive-displacement pumps and nonpositive-displacement pumps, i.e., centrifugal pumps. For operations such as the on-site extraction of oil and gas, suitable pumps include, but are not necessarily limited to pumps commercially available from Gardner Denver of Houston, Tex., U.S.A. In one embodiment for on-site extraction of oil and gas, fluid may be directed to the first fluid inlet 157 via a centrifugal pump such as a 4×5 or a 5×6 centrifugal pump commercially available from Gardner Denver.

Suitably, the first fluid inlet 157 is defined by a fluid flow control member such as a flow control valve or other shut-off mechanism operationally configured to (1) fluidly communicate with an external fluid conduit such as a pipe or hose, (2) dictate or control entry of fluid into the main line 147 of the system 10 and (3) dictate or control the rate of fluid flowing into the main line 147 of the system 10. The flow rate of supply fluid into the first fluid inlet 157 may also be metered by one or more flow meters including, but not necessarily limited to, electromagnetic flow meters and/or turbine flow meters. Suitable flow meters may be positioned at any upstream position along the main line 147 and mounted in any orientation as desired or otherwise required for a particular operation. In one particular embodiment, the first fluid inlet 157 may include a metered valve. As such, the system 10 is operationally configured to adjust the flow rate of supply fluid into the first fluid inlet 157 by adjusting the fluid flow control member as desired.

Likewise, the first fluid outlet 158 also includes a fluid flow control member such as a flow control valve or other shut-off mechanism operationally configured to (1) dictate or control the discharge of supply fluid out from the main line 147 of the system 10 and (2) dictate or control the rate of supply fluid flowing out from the main line 147 of the system 10. The flow rate of supply fluid out through the first fluid outlet 158 may also be metered by one or more flow meters including, but not necessarily limited to, electromagnetic flow meters and/or turbine flow meters. Suitable flow meters may be positioned at any downstream position along the main line 147 and mounted in any orientation as desired or otherwise required for a particular operation. In one particular embodiment, the first fluid outlet 158 may include a metered valve. As such, the system 10 is operationally configured to adjust the flow rate of supply fluid into the first fluid outlet 158 by adjusting the fluid flow control member as desired.

Suitable metered valves include, but are not necessarily limited to butterfly valves, ball valves, gate valves, and check valves. Suitable flow control valves may be manually operated (see the handles 17 and 18 in FIG. 20) or remotely operated via an actuator, e.g., an electric actuator, pneumatic actuator, or hydraulic actuator, in communication with a particular valve.

Suitably, the first fluid outlet 158 is operationally configured to fluidly communicate with one or more fluid conduits for discharging supply fluid out from the system 10. In one embodiment, a first fluid outlet 158 may be fluidly connected to one or more conduits for discharging supply fluid not used by the system 10 to one or more locations, such as discharge ponds, fluid tanks, truck tanks, and other storage and/or transport fluid containers. In an embodiment where the supply fluid includes water drawn directly from a natural source such as an ocean, lake, river, and the like, any water not used by the system 10 may be discharged back directly to its source. As discussed below, a first fluid conduit 158 may also be fluidly connected to a first fluid inlet of a second system 10.

Figure 28:
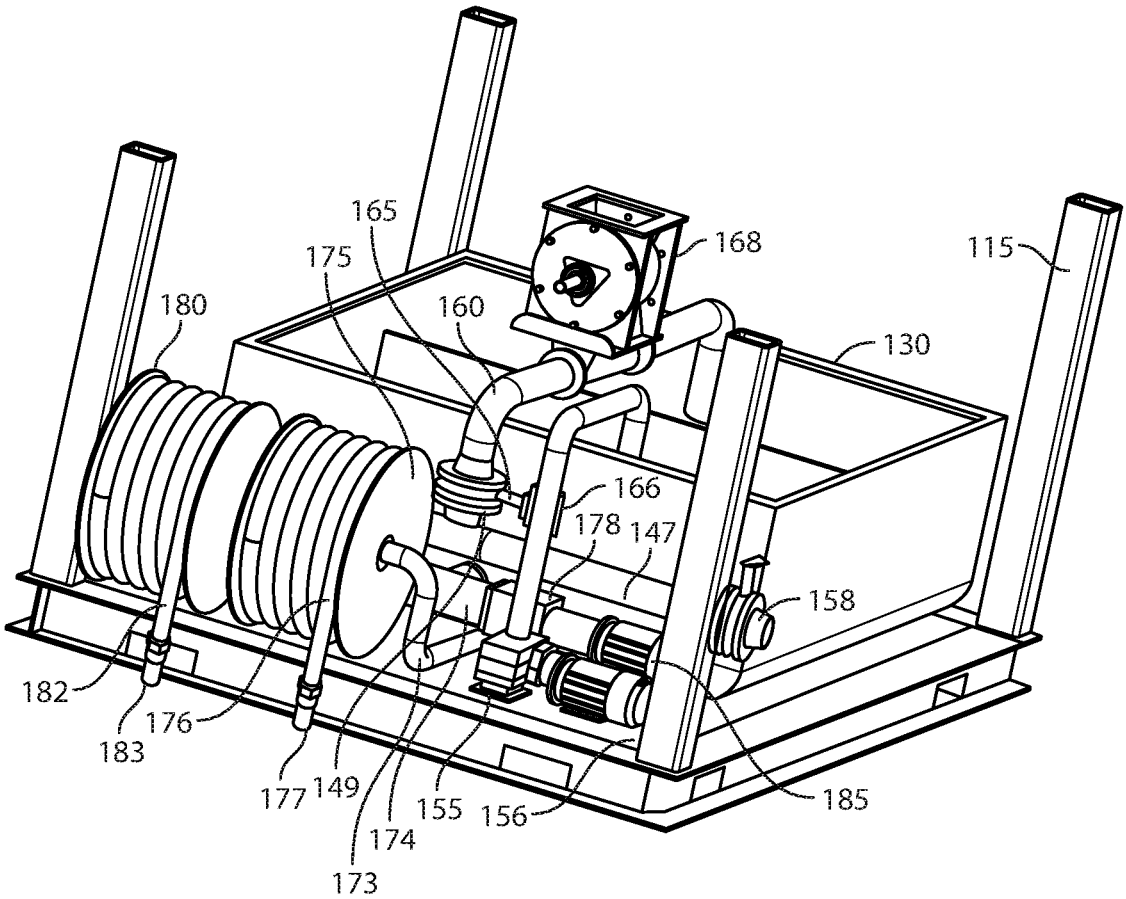
FIG. 28 is another view of a first module.

As shown in FIG. 20, the first module 100 includes at least a first fluid mixing line 160 ("mixing line 160") in fluid communication with the main line 147 that extends over the mixing tub 130, the mixing line 160 being operationally configured to convey fluid from the main line 147 into the first basin 140 via an outlet 161 of the mixing line 160 positioned above the first basin 140. With particular reference to FIG. 28, a mixing line 160 may be connected at a non-terminal section of the main line 147 via a side outlet 149. In one embodiment, the main line 147 may include a "tee" fitting or connector providing a side outlet for mixing line 160 connection. In another embodiment, the main line 147 may include a multiport three way valve providing a side outlet for mixing line 160 connection. In the embodiment of FIG. 28, the mixing line 160 is fluidly connected to a side outlet 149 via a fluid flow control member such as a flow control valve or other shut-off mechanism operationally configured to control the flow of fluid from the main line 147 into the mixing line 160 (hereafter referred to as "supply valve 165"). In one particular embodiment, the supply valve 165 may include a manually operated valve. In another embodiment, the supply valve 165 may be remotely controlled via a power operated actuator 166 as shown. Herein, an actuated valve 165 may also be referred to as a metering valve. One suitable actuated valve or metering valve includes, but is not necessarily limited to a butterfly valve operationally configured to control the volume and rate of fluid entering the mixing line 160. An actuated supply valve 165 may be electrically operated, hydraulically operated or pneumatically operated as understood by persons of ordinary skill in the art. A power source such as an air pressure supply is suitably located on or nearby the existing system 10. As an example, the power source for a pneumatically operated supply valve 165 may include a compressor situated near the system 10 with an air hose for providing the required air. An electric actuator is suitably electrically connected to an electrical generator, which may also be situated near the system 10, with an electrical power supply cable for providing the required electrical power to run the electric actuator. As understood by the skilled artisan, actuators may include integral controls operationally configured to provide feedback signals to the system 10 controls. As such, an actuated supply valve 165 may be monitored and operated via system 10 controls as discussed below.

With reference to FIGS. 20, 21, 26 and 28, the mixing line 160 may further include an inlet for receiving dry additive therein. In one embodiment of system 10 operation, the mixing line 160 may include a top fed mixing head member 168 in communication with a storage container 206 of a second module 200, the mixing head member 168 being operationally configured to receive dry additive from the storage container 206 and control the amount of dry additive entering the mixing line 160 wherein the dry additive is mixed with fluid flowing through the mixing line 160 toward the outlet 161. As such, the mixing line 160 is a first mixer of system 10 fluid.

In one embodiment, the mixing head member 168 may be provided as an integral part of the mixing line 160. In another embodiment, the mixing head member 168 may be releasably attached to the mixing line 160 via a connection such as a "tee" fitting or connector. Releasability allows for cleaning and maintenance of the mixing head member 168 without having to remove the entire mixing line 160 from the first module 100.

A suitable mixing head member 168 is operationally configured for accurate metering of dry additive housed within a storage container 206 during system 10 operation. In other words, a suitable mixing head member 168 is operationally configured to measure a specific volume of dry additive and effectively discharge the dry additive into the mixing line 160. A suitable mixing head member 168 may be manually operated and/or remotely operated. One suitable mixing head member 168 may include a valve for controlling the flow of dry additive into the mixing line 160. For example, a mixing head member 168 may include a knife gate valve operationally configured to proportion a desired amount of dry additive entering the mixing line 160. Without limiting the invention, one suitable mixing head member 168 may include a remotely controlled volumetric feeder with one or more flow meters that are monitored and operated via system 10 controls. One suitable volumetric feeder includes a volumetric screw feeder. In one embodiment, a mixing head member 168 may be in wireless communication the system 10 controls. In another embodiment, a mixing head member 168 may be communicated with the system 10 controls via an electrical connection on the first module 100. Without limiting the invention, a suitable commercial source of volumetric feeders includes, but is not necessarily limited to Acrison, Inc. of Moonachie, N.J., U.S.A. Exemplary volumetric feeders include, but are not necessarily limited to those provided below in Table 2.

TABLE 2

| |
|---|
| 1. Single Auger Metering system Model 101/130 Series. |
| 2. Dissimilar Speed double concentric auger metering mechanism, Model 105/140 Series. |
| 3. Dissimilar Speed Dual Auger/Agitator metering mechanism. Model 1015 Series. |
| 4. Dissimilar Speed Triple Auger/Agitator Metering Mechanisms - Model BDF Series. |
| 5. Dual Independent Metering Augers for Both Continuous & Batching Applications - Model BDFX-1.5-2. |
| 6. Self-Emptying Single Auger/Agitator Metering Mechanisms - Model 170 Series. |
| 7. Self-Emptying Dual Auger/Agitator Metering Mechanisms - Model 170 Series. |
| 8. Micro-Ingredient Volumetric Feeder for Very Low Feed Rates - Model 170-MI-5. |
| 9. Dissimilar Speed Double Concentric Auger Feeder with Flow Inducing Hopper - Model 120. |
| 10. Volumetric Feeders for Metering Fiberglass - Single Auger Mechanisms - Models V101 and V130. |
| 11. Specifically Designed to Meter Strand-Type Materials - Model 905-18 Series. |

As understood by the skilled artisan, the mixing head member 168 suitably includes an engagement surface 169 operationally configured as a seat for receiving a corresponding outlet 208 of a storage container 206 thereon in a manner effective to prevent dry additive from exiting of the system 10 at the point of attachment. As such, the engagement surface 169 and/or outlet 208 may be provided with one or more seals or gasket material. In another embodiment, the engagement surface 169 and outlet 208 may include a machine fit operationally configured to prevent loss of dry additive from the system 10 at the point of attachment. As also understood by the skilled artisan, the mixing head member 168 and outlet 208 may be secured via one or more fasteners via corresponding through holes of each. Suitable fasteners include, but are not necessarily limited to threaded nut/bolts.

As discussed below, the present system 10 may be configured to produce fluid mixture compositions of varying thicknesses or viscosities for one or more particular uses. As understood by the skilled artisan, some fluid mixture compositions may be more flowable than others. As such, a first module 100 may be operationally configured to discharge fluids of varying viscosities out from the second basin 145 as desired. For example, a second basin 145 may be provided with one or more outlets in the sidewall 134 of the mixing tub 130 operationally configured for discharging fluid mixture compositions of a varying viscosities or ranges of viscosities. As shown in the simplified illustration of FIG. 29, a second basin 145 may include a first outlet 125 operationally configured for discharging fluid mixture compositions of low viscosities, e.g., up to about 4.0 mPa s. The second basin 145 may include one or more additional outlets, e.g., second outlet 126, for discharging fluid mixture compositions of higher viscosities, e.g., greater than about 4.0 mPa s. As shown, the second outlet 126 includes a larger diameter than the first outlet 125 for handling thicker discharge of fluid mixture compositions. However, the one or more discharge outlets 125, 126 are not necessarily limited to any particular size or arrangement, but rather are provided in number, size, shape and location effective for the discharge of one or more particular fluid mixture compositions to be fed into the second basin 145. Also, the one or more discharge outlets 125, 126 may each include a cover similar as known drain covers. Likewise, the outlet 152 of the first basin 140 may also include a drain cover. Suitable drain covers may be operationally configured to filter or trap certain sized solids from flowing out from the first and/or second basins 140, 145.

With reference now to FIG. 28, the first module 100 further includes a low viscosity conduit 173 in fluid communication with the first outlet 125 for discharging fluid mixture compositions out from the second basin 145. A low viscosity conduit 173 may be configured as desired and may include an outlet effective for fluid connection with one or more external sources such as fluid storage tanks and the like. A low viscosity conduit 173 may also include an outlet operationally configured to discharge fluid mixture compositions directly to one or more natural formations or other locations, such as bodies of water, dry land, farm crops. As shown in FIG. 28, a low viscosity conduit 173 may be fluidly communicated with a first hose reel 175 including a first hose 176 in fluid communication with the first hose reel 175 for discharging fluid mixture compositions out from the system 10 through an outlet 177 of the first hose 176. As understood by the skilled artisan, a first hose 176 may include a length according to its outer diameter and reel size and may be unwound a distance as desired during operation—a distance up to its entire length. One non-limiting first hose reel 175 may include a spring-driven hose reel for ease of rewind. In one suitable mode of operation, the first hose 176 may be fluidly communicated with a pump operationally configured to draw low viscosity fluid mixture compositions out from the second basin 145. For example, for operations such as on-site extraction of oil and gas, a first hose 176 may be fluidly communicated with a pump of a trailer or truck mounted fracturing blender or a hydration unit. One non-limiting pump may include a positive displacement pump.

Suitably, a first module 100 may further include a high viscosity conduit in fluid communication with the second outlet 126 for discharging fluid mixture compositions out from the second basin 145. Like the low viscosity conduit 173, the high viscosity conduit 174 may be configured as desired and may include an outlet effective for fluid connection with one or more external sources such as fluid storage tanks and the like. A high viscosity conduit 174 may also include an outlet operationally configured to discharge fluid mixture compositions directly to one or more natural formations or other locations, such as bodies of water, dry land, farm crops or be fluidly communicated with a pump operationally configured to draw high viscosity fluid mixture compositions out from the second basin 145.

As shown in FIG. 28, a first module 100 may further include a discharge pump 178 in fluid communication with the second outlet 126 and high viscosity conduit 174 operationally configured to facilitate the discharge of thicker or heavier fluid mixture compositions not desired for discharge via the first outlet 125. In this embodiment, the discharge pump 178 is fluidly communicated with a second hose reel 180 via conduit 179 as shown in FIG. 26. The second hose reel 180 may be of similar construction as the first hose reel 175 including a second hose 182 for discharging fluid mixture compositions out from the system 10. A suitable discharge pump 178 for high viscosity fluids or fluid mixture compositions includes, but is not necessarily limited to a progressive cavity pump. In one embodiment, a discharge pump 178 may be solely responsible for the discharge of fluid mixture compositions out from the second basin 145 via the outlet 183 of the second hose 182. In another embodiment, one or more external pumps, similar as described above in relation to the low viscosity conduit 173, may be fluidly communicated with the second hose 182 for the discharge of fluid mixture compositions from the system 10.

Suitably, the first and second hose reels 175, 180 each include a base section for releasable securement to the first support surface 108. For example, the first support surface 108 may include through holes for receiving fasteners there through, e.g., nut/bolt fasteners, threaded fasteners for mating with threaded through holes. Exemplary hose reels 175, 180 for use as part of the system 10 are commercially available from sources including, but not necessarily limited to Reelcraft Industries, Inc., Columbia City, Ind., U.S.A. and Hannay Reels Inc., Westerlo, N.Y., U.S.A.

The one or more materials of construction of the first and second hoses 176, 182 may vary according to the system 10 operation. Suitable hoses 176, 182 may include common rubber hoses and industrial hoses including, but not necessarily limited to chemical suction and discharge hoses operationally configured for the transfer of corrosive fluids, acids, alkaline fluids, chemicals, solvents, petroleum products, and combinations thereof. Although the first and second hoses 176, 182 are not necessarily limited to any particular size, first and second hoses 176, 182 provided for the extraction of oil and gas, e.g., hydraulic fracturing operations, may include an inner diameter of about 3.81 cm (about 1.50 inches) and a length of about 30.48 meters (about 100.0 feet). As understood by the skilled artisan, the size and/or type of hose utilized may vary according to the system 10 operation and/or the target industry of system 10 application.

Still referring to FIG. 28, the first module 100 may include a power source 185 located on the base support of the first module 100 operationally configured to power the discharge pump 178. A suitable power sources 185 for the discharge pump 178 may include a power source 185 similar as described above in relation to a power source 156 for powering a first pump 155. Likewise, a power source 185 and discharge pump 178 may be provided on a removable support for mounting to the first support surface 108 of the first module 100 as described above.

To control the flow of fluid out from the second basin 145, the first and second outlets 125, 126 may be fitted with valves as desired. Suitable valves include, but are not necessarily limited to butterfly valves controlled by an electric actuator, a pneumatic actuator, or a hydraulic actuator as described above. As such, any valves located at the first and second outlets 125, 126 are suitably communicated with the system 10 controls for opening and closing such valves.

Figure 30:
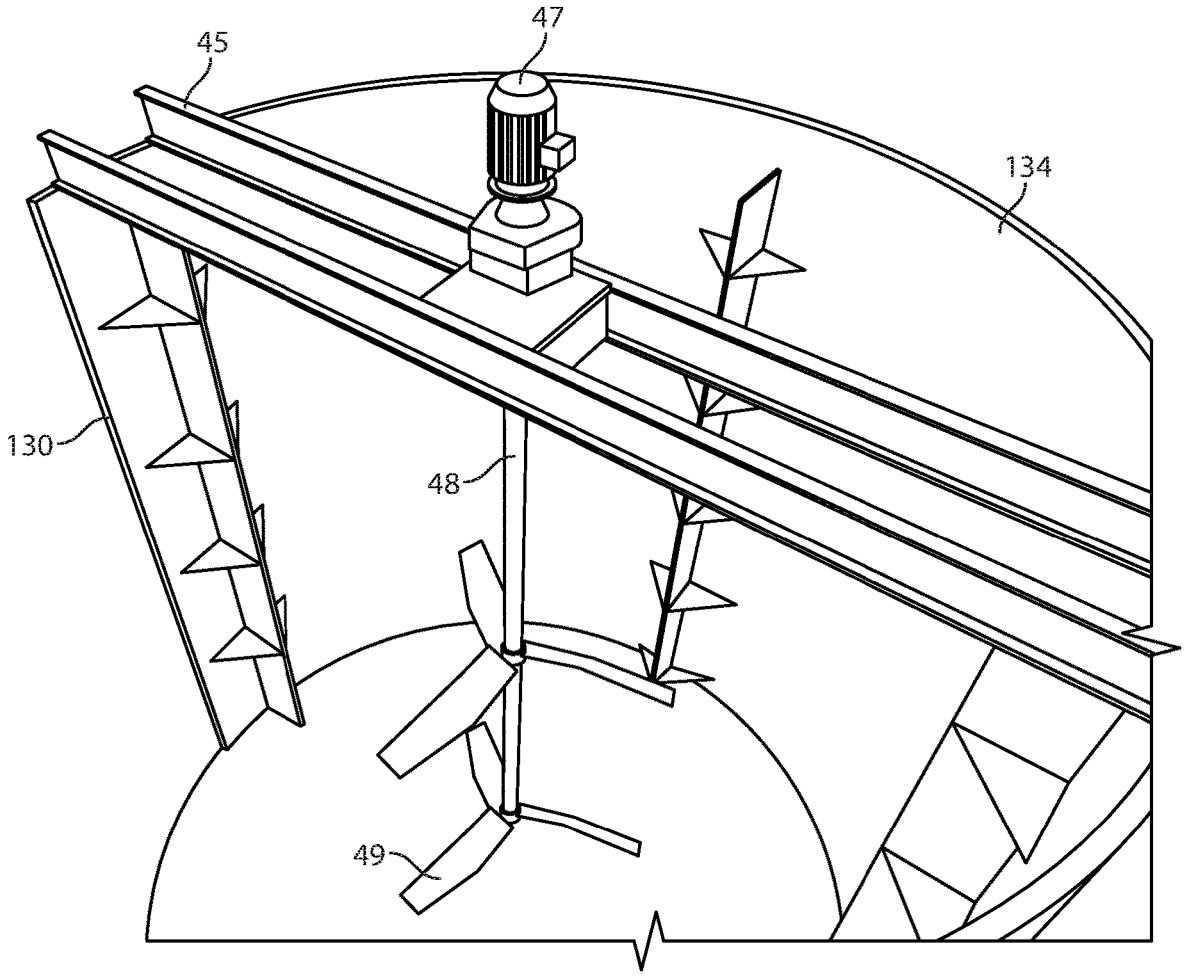
FIG. 30 is a partial view of a mixing tub including a cross-beam suspending a fluid mixer into the mixing tub.

To facilitate additional mixing of a fluid mixture composition contained within the second basin 145, a first module 100 may further be provided with one or more stirring members. As shown in FIG. 30, the mixing tub 130 may include at least one cross-beam 45 or similar construction operationally configured to suspend at least one fluid mixer 47 over the second basin 145. As shown in this embodiment, the fluid mixer 47 includes a cylindrical stem 48 with one or more paddle members 49 effective to agitate a fluid mixture composition in the second basin 145 and eliminate or minimize dead spots in the fluid mixture composition. As understood by the skilled artisan, the length of the stem 48 may be dictated according to the dimensions of the second basin 145 of the mixing tub 130. Likewise, the dimensions of the one or more paddle members 49 may be dictated according to the dimensions of the second basin 145 and/or the viscosity of one or more fluid mixture compositions to be produced by the system 10. Exemplary paddle members 49 for use herein are described in U.S. Pat. No. 7,524,386, titled "Method for Wet Mixing Cementitious Slurry for Fiber-Reinforced Structural Cement Panels," issued on Apr. 28, 2009, which is herein incorporated by reference in its entirety. A suitable fluid mixer 47 is commercially available from AIM Blending Technologies, Pleasanton, Calif., U.S.A. In addition, the paddle members 49 may be pneumatically, electrically or hydraulically driven at variable speeds ranging from about 1.0 rotations per minute (RPM) up to about 400.0 RPM.

In one embodiment, one or more cross-beams 45 may be provided as fixed members of a mixing tub 130. In another embodiment, one or more cross-beams 45 may be provided as removable members for resting atop adjacent or opposing sidewalls 134 of a mixing tub 130. In another embodiment, one or more cross-beams 45 may be releasably secured to a mixing tub 130 via one or more fasteners. In still another embodiment, the sidewalls 134 may include openings there through for receiving opposing ends of cross-beams 45 allowing cross-beams 45 to rest within an upper portion of the second basin 145.

Figure 13:
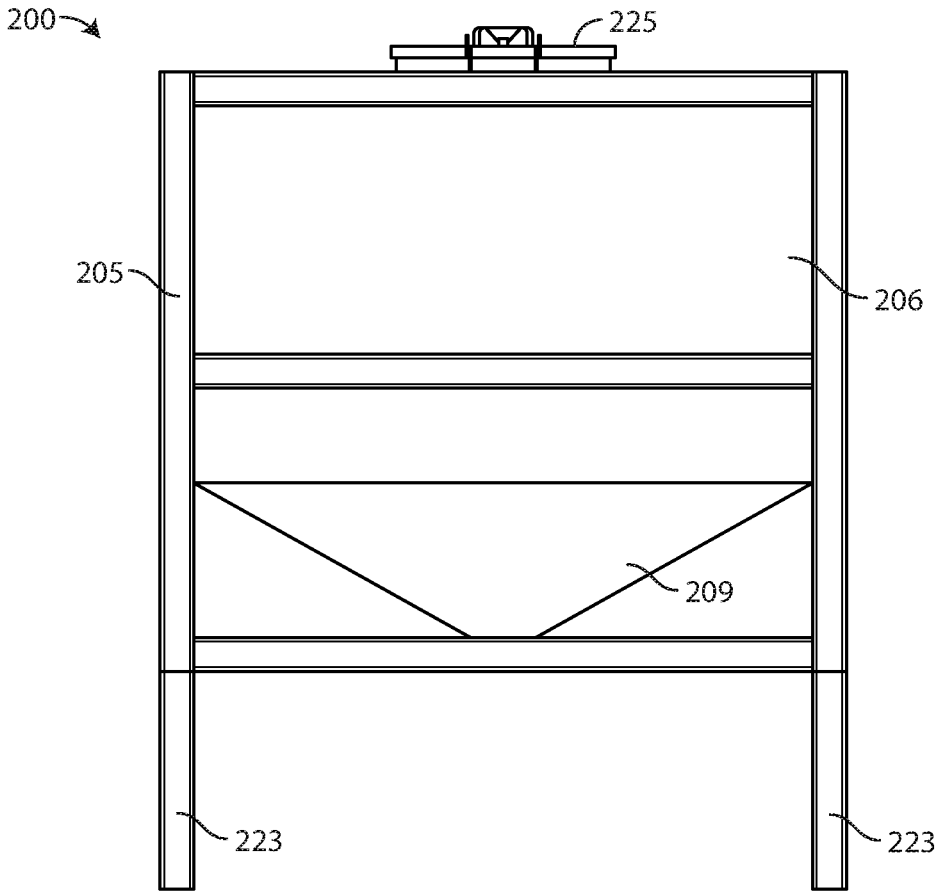
FIG. 13 is a side view of an embodiment of a second module.

As stated above, a framework 205 of the second module 200 may be provided as an open frame configuration for securing one or more dry additive storage containers 206. With reference to FIG. 13, one suitable dry additive storage container 206 may be provided as a gravity bin in the form of a hollow vessel with an inlet provided as a sealable hatch 225 along the upper portion of the container 206 for feeding dry additive into the storage container 206 and an outlet 208 for discharging of the dry additive located at the bottom of the storage container 206. As shown, a suitable storage container may include a tapered discharge section 209 effective for discharge of dry additive or other materials out through the outlet 208. The size and/or shape of the hatch 225 may vary, but a suitable hatch 225 is large enough to provide for delivery of dry additive into the storage container 206 at a desired rate and provide for ease of entry into the storage container for cleaning and/or maintenance purposes.

Figure 31:
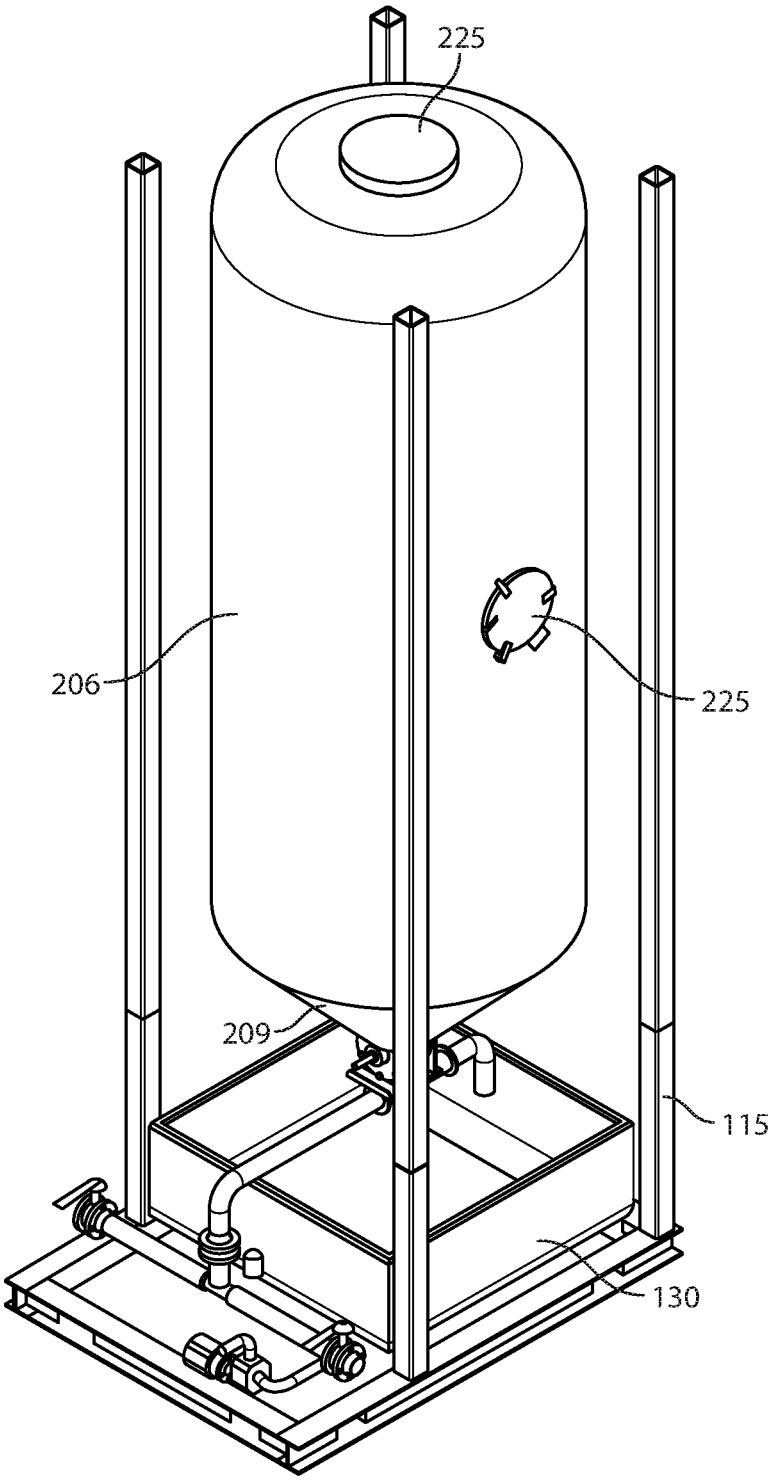
FIG. 31 is a perspective view illustrating a simplified second module stacked atop a simplified first module.

In another embodiment, as shown in FIG. 31, one or more dry additive storage containers 206 may be provided as hollow cylindrical vessels with a tapered conical discharge section 209. One particular dry additive storage containers 206 may include a cylindrical pressure vessel. A sealable hatch 225 may be located along the top of the dry additive storage container 206 and/or along a sidewall section of a dry additive storage container 206—both types are illustrated in the simplified embodiment of FIG. 31. A suitable framework 205, dry additive storage container 206 and sealable hatch 225 for use herein are described in U.S. Pat. No. 8,585,341, titled "Proppant discharge system and a container for use in such a proppant discharge system," issued on Nov. 19, 2013, which is herein incorporated by reference in its entirety.

Dry additive storage containers 206 (or "storage containers 206") may be constructed from one or more materials durable for system 10 operation as desired and/or as may be required by law or regulation. Suitable materials of construction include, but are not necessarily limited to those materials resistant to chipping, cracking, excessive bending and reshaping as a result of ozone, weathering, heat, moisture, other outside mechanical and chemical influences, as well as impacts. In particular, a storage container 206 may be constructed from materials including, but not necessarily limited to metals, plastics, fiberglass, plexiglass, filled composite materials, and combinations thereof. In an embodiment of a system 10 operationally configured for oil and gas related hydraulic fracturing operations, a storage container 206 is suitably constructed from one or more metals. Suitable metals include, but are not necessarily limited to stainless steel, mild steel, aluminum, and combinations thereof.

In one or more embodiments, it may be desirable to monitor second module 200 operations to ensure that one or more predetermined parameters are met. As such, a second module 200 may be provided with one or more monitoring systems effective for monitoring (1) the temperature of the dry additive within a storage container 206, (2) the humidity within a storage container 206, and (3) the volume of dry additive within a storage container 206. For example, storage containers 206 may include one or more sensors effective for monitoring the temperature, humidity or moisture, and the volume of dry additive located within a storage container 206.

In one embodiment, one or more sensors may be disposed along the inner surface of the storage container 206. In another embodiment a suitable temperature sensor may include, but is not necessarily limited to a suspended vertical member having one or more temperature sensors along its length such as a temperature cable effective to detect hot spots. Exemplary temperature sensors for use herein are described in U.S. Pat. No. 4,583,300, titled "Automatic Grain Drying System," issued on Apr. 22, 1986; and U.S. Pat. No. 6,732,580, titled "Level Sensor and Control," issued on May 11, 2004; each of which is herein incorporated by reference in its entirety.

One or more moisture sensors may also be disposed along the inner surface of the storage container 206 in a manner effective to detect moisture therein. A suitable type of moisture sensor includes, but is not necessarily limited to digital microwave moisture measurement sensors commercially available from Hydronix America, Harbor Springs, Mich., U.S.A. Another suitable moisture sensor includes a moisture test sensor commercially available from PCE Instruments (PCE Americas Inc.), Jupiter, Fla., U.S.A.

A storage container 206 may include one or more volume level sensors positioned at different levels within the storage container 206 allowing users to identify the volume of dry additive available at any given time during system 10 operation, e.g., a maximum capacity sensor, a half-full sensor and a low level sensor. Non-limiting examples of volume level sensors for use with storage containers 206 of this application are described in U.S. Pat. No. 7,147,361, titled "Methods for Injecting Dry Bulk Amendments for Water and Soil Treatment," issued on Dec. 12, 2006; and U.S. Pat. No. 6,732,580, led "Level Sensor and Control," issued on May 11, 2004; each of which is herein incorporated by reference in its entirety.

In another embodiment, a storage container 206 may be provided with one or more heating members effective to minimize or otherwise eliminate any humidity within the storage container 206. For example, a storage container 206 may be provided with an opening or "air gap" in fluid communication with a heating member attached thereto for directing heated dry air through the air gap into the storage container 206.

As understood by the skilled artisan, one anticipated problem in regard to the mixing of fluids and dry additives includes the introduction of undesired air into a fluid mixture composition. Air entrained in a particular mixture may cause the overall volume of a fluid mixture composition in the mixing tub 130 to be greater than expected. Additionally, air entrained in a particular mixture may cause the measured density of a particular fluid mixture composition to be lower than expected. As such, the system 10 may include one or more gas sensors at one or more of (1) the first fluid inlet 157, (2) the main line 147 and (3) the mixing line 160. One suitable gas sensor is operationally configured to detect one or more acid gases or vapors. In one particular embodiment, the system 10 may include one or more gas sensors operationally configured to detect gases or vapors of acetic acid, acetone, acetylene, alchohol, ammonia, aromatic isocyanates (toluene diisocyanate. (TDI) and methylene diphenyl diisocyanate (MDI)), arsine, bromine, carbon dioxide, carbon monoxide, chlorine, chlorine dioxide, diborane, dimethylamine, ethylene oxide, fluorine, formaldehyde, germane, glutaraldehyde, hydrazine, hydrocarbons, hydrogen, hydrogen bromide, hydrogen chloride, hydrogen cyanide, hydrogen fluoride, hydrogen peroxide, hydrogen selenide, hydrogen sulfide, iodine, mercury, methane, nitric oxide, nitrogen dioxide, nitrogen oxides, non-methane hydrocarbons (NMHC), oxygen, ozone, particulate matter, peracetic acid, perchloroethelyne, phosgene, phosphine, silane, sulfur dioxide, and volatile organic compounds (VOCs). In one particular embodiment, one or more gas sensors are suitably located at or near the top of the storage container 206.

As described above, the system 10 may require power in the form of one or more of hydraulic power, pneumatic power and electrical power. For example, hydraulic power may be provided to drive the one or more fluid transfer pumps located external the system 10 and/or the pumps provided as part of the first module 100. Pneumatic power may be provided to drive the various valves of the system 10. Electrical power is suitably provided for driving electrical system 10 devices such as electrical motors, screw feeders of the second module 200, light sources on or near the first and/or second modules 100, 200, one or more alarms on or near the system 10 such as visual and/or audible alarms, and the system 10 controls. The required power may originate from one or more sources, e.g., separate sources for hydraulic power, pneumatic power and electrical power. For permanent system 10 installation such as in an industrial facility, the system 10 may make use of hydraulic power, pneumatic power and electrical power built into the facility. In an embodiment of the system 10 for mobile on-site operation, hydraulic power, pneumatic power and electrical power may be provided via separate mobile sources of hydraulic power, pneumatic power and electrical power. In another embodiment for mobile on-site system 10 operation, a single mobile power generator such as a power module or power system may be provided for housing each of a hydraulic power source, a pneumatic power source and an electrical power source. One suitable power system for use is described in U.S. Publication No. 2018/0298731 (application Ser. No. 15/955,521), titled "Power System and Method," published Oct. 18, 2018, herein incorporated by reference in its entirety.

Running, monitoring, recording and supervising system 10 operation may be performed manually and/or via a process control system. A safety instruments system may also be employed that is designed to help prevent certain unwanted events from occurring. In one embodiment, a safety instruments system may be integrated as part of a process control system. In general, one suitable process control system may include an engineered set of hardware and software controls for centralized computer based oversight of system 10 operations.

A suitable process control system may be operated either (1) locally, i.e., near where the process is being performed, or (2) remotely, i.e., spaced apart from where the process is being performed. Remote control implies the need for some communication means between a local control system located near where the system 10 operation is being performed and a remote control system spaced apart from such location. To facilitate installation and to preclude overly obstructing an on-site area between the local and remote control systems, such communication should be relatively simple and compact; but also capable of handling sufficient quantities and rates of data transmission in both directions between the local and remote control systems.

Figure 32:
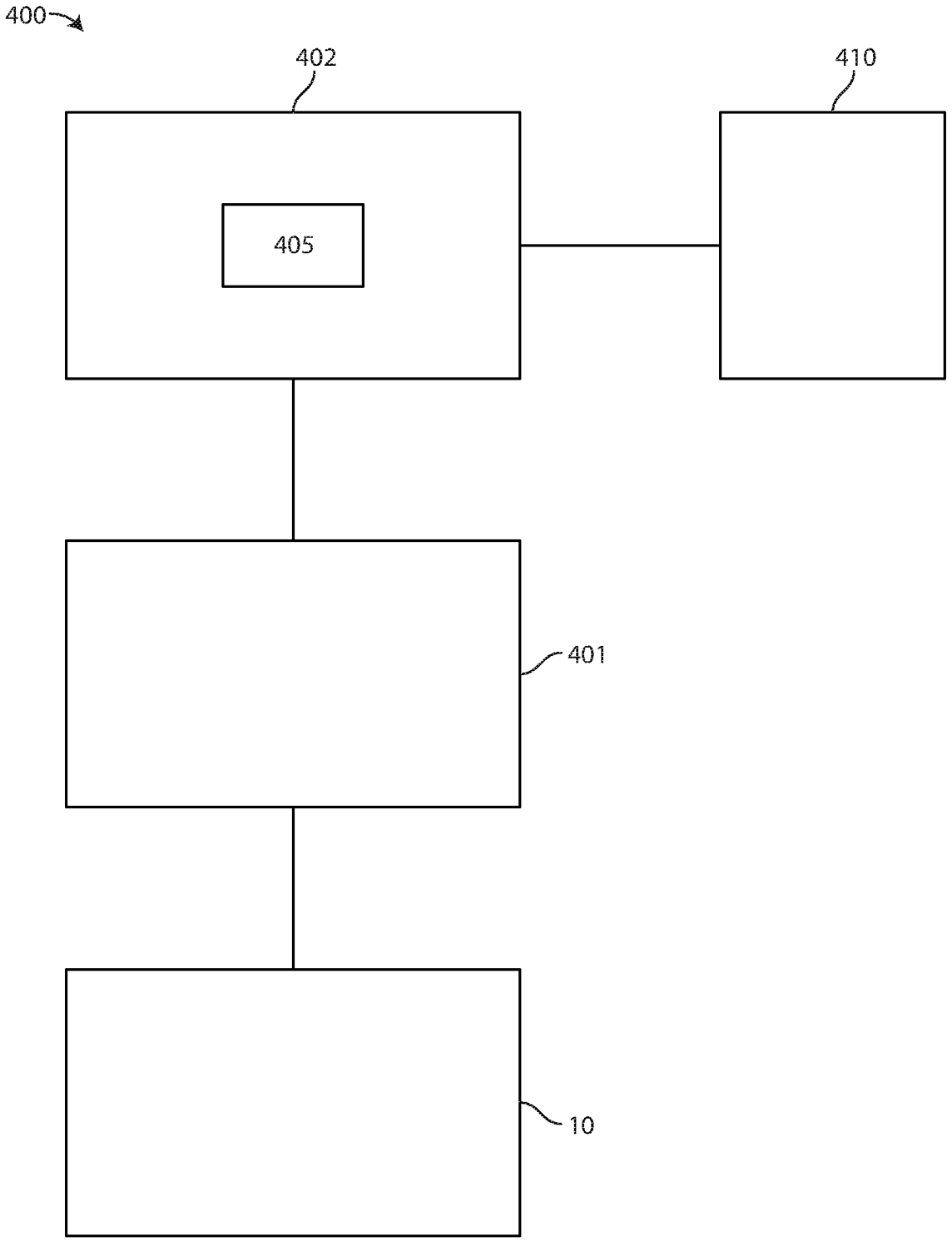
FIG. 32 is a flowchart representing basic operation of a process control system of the present application.

The process control system of the present invention is generally identified in FIG. 32 by the reference numeral 400. In simplified operation, a process control system 400 includes a computerized system operationally configured to (1) control the flow of fluid into the system 10 via the first fluid inlet 157, (2) control the flow of fluid out from the system 10 via the first fluid outlet 158, (3) control the flow of fluid into the first basin 140, (4) control the flow of dry additive out of the storage container 206 into the mixing line 160, (5) control the transfer of fluid mixture compositions between the first basin 140 and the second basin 145, (5) control the flow of fluid mixture compositions out from the second basin 145 in a manner effective to produce a desired fluid mixture composition to one or more target locations for further use. A process control system 400 may also be operationally configured to control one or more power sources, light sources of the system 10, either external of the system 10 and/or part of the module 100, 200 build.

Suitably, the process control system 400 includes an interface such as electrical control circuitry 401 in communication with the various component parts of the first and second modules 100, 200, e.g., pumps, valves, sensors, power sources, as well as external equipment such as pumps, power sources and computer databases. As discussed below, the process control system 400 may be operated via one or more control centers 402 housing computer hardware 405 including one or more computer programs in communication with the control circuitry 401 of the system 10 for automatically monitoring, controlling and adjusting the flow of the fluid supplied into the system 10, the rate of mixing dry additive and fluid, the transfer of fluid mixture compositions between basins 140, 145, and the fluid discharge rate out from the system 10. More particularly, the process control system 400 may be programmed to (1) open and close a fluid flow control member such as a flow control valve or other shut-off mechanism of the first fluid inlet 157, (2) open and close a fluid flow control member such as a flow control valve or other shut-off mechanism of the first fluid outlet 158, (3) open and close a flow control valve or other shut-off mechanism operationally configured to control the flow of fluid from the main line 147 into the mixing line 160, (4) open and close the mixing head member 168, (5) control operation of the power source 156 and first pump 155, (6) control operation of the fluid mixer 47, (7) control operation of the power sources 185 and discharge pump 178, (8) open and close a flow control valve or other shut-off mechanism of the first outlet 125 of the second basin 145, (9) monitor the volume of fluid mixture compositions in the first and second basins 140, 145, (10) monitor the temperature of fluid mixture compositions in the first and second basins 140, 145, (11) monitor the volume of dry additive in the storage containers 206, (12) monitor the humidity within the storage containers 206, (13) monitor the temperature within the storage containers 206, (13) communicate with one or more system 10 tracking devices and the Global Positioning System, or equivalent, (14) control one or more light sources of the system 10, (15) communicate with one or more system 10 alarms, (16) communicate with any flow meters disposed within the various conduits, inlets and outlets and (17) communicate with one or more gas sensors of the system 10.

Suitably, the computer hardware 405 used requires little or no hardware modification, the only modifications needed are contemplated to be software changes applicable to the particular requirements of a particular process to be controlled or monitored. Suitable computer hardware may include a local control computer, an interface operationally configured for communicating computer hardware 405 to the system 10 and cable for electrically connecting the computer hardware 405, interface 425 and the system 10. As mentioned above, local controls may be housed within one or more control centers 402. For facility operations, one exemplary control center 402 may include one or more rooms dedicated to process control system 400 use. For on-site operations, one or more mobile structures may be employed for housing the local controls such as the computer hardware 405. In oil and gas extraction operations, a suitable control center 402 may include a data van or equivalent as understood by persons of ordinary skill in the art. One or more other control centers 410 may be included for remote system 10 operation.

For operation of a system 10 as shown in FIG. 1 effective for producing a particular fluid mixture composition, the following parameters are suitably determined prior to system 10 operation: (1) the type of dry additive to be used, (2) the type of one or more fluids to be used, and (3) the volume of one or more fluids and dry additive to be used. In a batch operation, the volume of fluid and dry additive may be predetermined to provide a predetermined volume of a fluid mixture composition. In a continuous operation, parameters such as (1) the constant volume and rate of fluid flow from the main line 147 into the mixing line 160 and (2) the constant volume and rate of dry additive fed into the mixing line 160 are required for providing a predetermined fluid mixture composition to one or more locations downstream of the system 10.

In terms of continuous system 10 operation, two scenarios of operation are contemplated. In a first simplified scenario, including the production of a low viscosity fluid mixture composition as defined above, and with knowledge of the size of the various conduits and basins 140, 145 of the system 10, the process control system 400 may be programmed to open the first fluid inlet 157 and the supply valve 165 to allow a constant flow rate of fluid, e.g., water, to be conveyed to the first basin 140 via the mixing line 160. The process control system 400 is also suitably programmed to feed a volume of dry additive from the storage container 206 into the mixing line 160 at a rate effective to provide a desired fluid mixture composition in the first basin 140. Suitably, the flow of fluid and dry additive is constantly metered whereby the process control system 400 is programmed to adjust the flow of fluid and/or dry additive as may be required to produce the desired fluid mixture composition. Over time, once the fluid mixture composition fills the first basin 140, the fluid mixture composition naturally begins to spill over the divider 133 into the second basin 145 whereby the fluid mixture composition may further mix during transfer from the first basin 140 to the second basin 145 and may be discharged from the system via the low viscosity conduit 173 as described above. This scenario is an example of internal fluid transfer.

In a second simplified scenario, including the production of a high viscosity fluid mixture composition as defined above, the volume of fluid mixture composition conveyed into the first basin 140 is suitably measured via one or more fluid level sensors 50 of the first basin 140. Once the volume of the fluid mixture composition (or "first fluid mixture composition") reaches a predetermined level within the first basin 140, the process control system 400 is programmed to activate the first pump 155 in order to transfer the fluid mixture composition to the second basin 145 via the mixing tub conduit 150. As described above, the first pump 155 is suitably operationally configured as a second mixer of the system 10 fluid to create at least a sufficiently-high shear rate to facilitate further mixing of the fluid and dry additive, i.e., "modify" the fluid and dry additive, effective for producing a flowable or pumpable fluid mixture composition in the second basin 145 (or "second fluid mixture composition") that may thereafter be discharged via the high viscosity conduit 174 as describe above. This scenario is an example of external fluid transfer.

During system 10 operation, quality control tests of the supply fluid, dry additives, and fluid mixture composition may be performed on-site or at a separate remote location for monitoring the quality of the fluid mixture composition being produced by the system 10, in regard to the fluid mixture composition, an operator may take one or more samples of the fluid mixture composition directly from the first and/or second basins 140, 145 for testing. The results of such testing may be used to reprogram the process control system 400 to adjust the flow rates and/or volumes of the fluid supply and/or dry additive of the system 10. For external fluid transfer operations, the viscosity of the fluid mixture composition in the second basin 145 may be sampled and measured, whereby the process control system 400 may be reprogrammed to adjust the speed of the first pump 155.

In another embodiment a first fluid outlet 158 of a first system 10 may be fluidly communicated with a first fluid inlet 157 of a second system 10 via a fluid conduit 23 for mixing operation of the second system 10. As such, the present application is further directed to a system comprising a plurality of individual systems 10 fluidly assembled via the first fluid inlet 157 and first fluid outlet 158 of each system 10 using interconnecting fluid conduits 23 for conveying supply fluid from one or more common fluid sources to one or more of the individual systems 10 assembled together.

Figure 33:
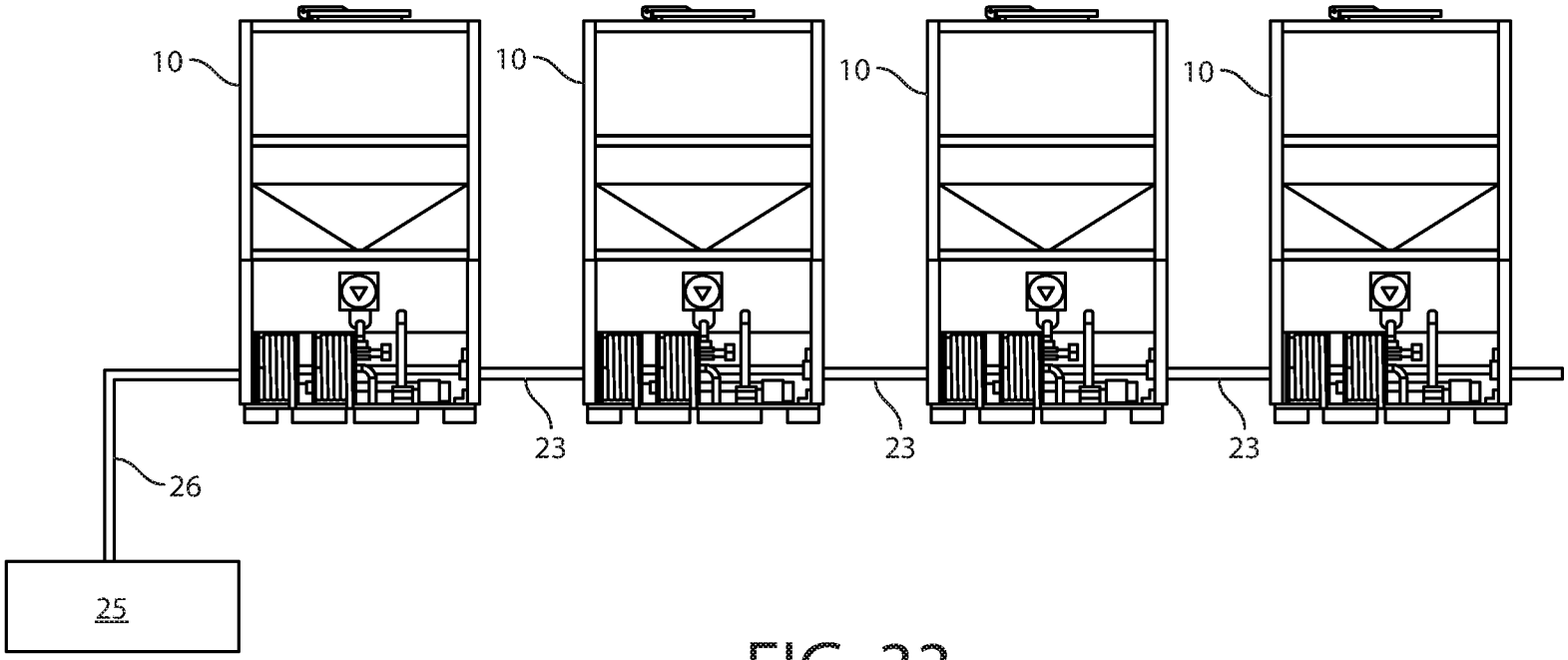
FIG. 33 illustrates a system fluid source and four individual systems interconnected as a cascade.

In the simplified example of FIG. 33, which depicts a total of four individual systems 10 interconnected as a cascade, a first upstream individual system 10 is fluidly communicated with a fluid source 25 via a fluid conduit 26 in fluid communication with its first fluid inlet 157. As further shown, a first fluid conduit 23 is fluidly connected to the first fluid outlet 158 of the first upstream individual system 10 and the first fluid inlet 157 of a second adjacent individual system 10, with each successive individual system 10 fluidly communicated in a similar manner. In one embodiment, each of the four individual systems 10 may be utilized for mixing purposes. In another embodiment, less than all of the individual systems 10 may be utilized for mixing purposes. For example, there may be a desire to operate only the third individual system 10, e.g., according to its location or proximity to something.

In such embodiment, the first fluid inlet 157 and first fluid outlet 158 of each of the first two upstream systems 10 are set to an open position while the first fluid inlet 157 of the third system 10 is set to an open position and the outlet 158 of the third system 10 is set to a closed position. Such arrangement allows supply fluid to pass through the first two upstream systems 10 into the third system 10 for mixing operations. By setting the outlet 158 of the third system to a closed position, supply fluid is prevented from flowing to the fourth system 10.

As stated above, an individual system 10 may be built to scale to handle a particular mixing operation. However, in a scenario making use of first modules 100 of a known size, the ability to combine a plurality of individual systems 10 as shown in FIG. 33 is effective to scale up a mixing operation of the system 10 to meet one or more fluid volume mixing demands.

In another embodiment, rather than combine a plurality of systems 10 as shown in FIG. 33, a plurality of individual systems 10 may be employed as standalone units for mixing operations. In an embodiment including a plurality of individual systems 10, each of the individual systems 10 may draw supply fluid from a common source. In another embodiment, a plurality of individual systems 10 may be able to optionally draw supply fluid from one or more separate sources.

In another embodiment, a fluid mixture composition may be produced by utilizing a first module 100 alone or without use of a second module 200. For example, where a second module 200 malfunctions or otherwise is unavailable, dry additive may be manually fed to the first module 100. As such, the process control system 400 may be programmed to calculate manual feed rates of dry additives.

As described herein, the supply fluid and dry additive used may vary according to one or more desired fluid mixture compositions. At a minimum, the supply fluid and fluid mixture compositions produced are flowable through each of the conduits, pumps, valves, blenders, hoses, inlets and outlets of the first module 100. In one aspect, suitable dry additives include materials soluble in one or more target fluids. In another aspect, suitable dry additives include materials effective to be conveyed out from the second module 200 into the mixing line 160. Because certain dry additives may be more concentrated per volume depending on the source of the dry additive, such may be factored in when calculating the volume of dry additive to be used in producing one or more fluid mixture compositions.

Figure 34:
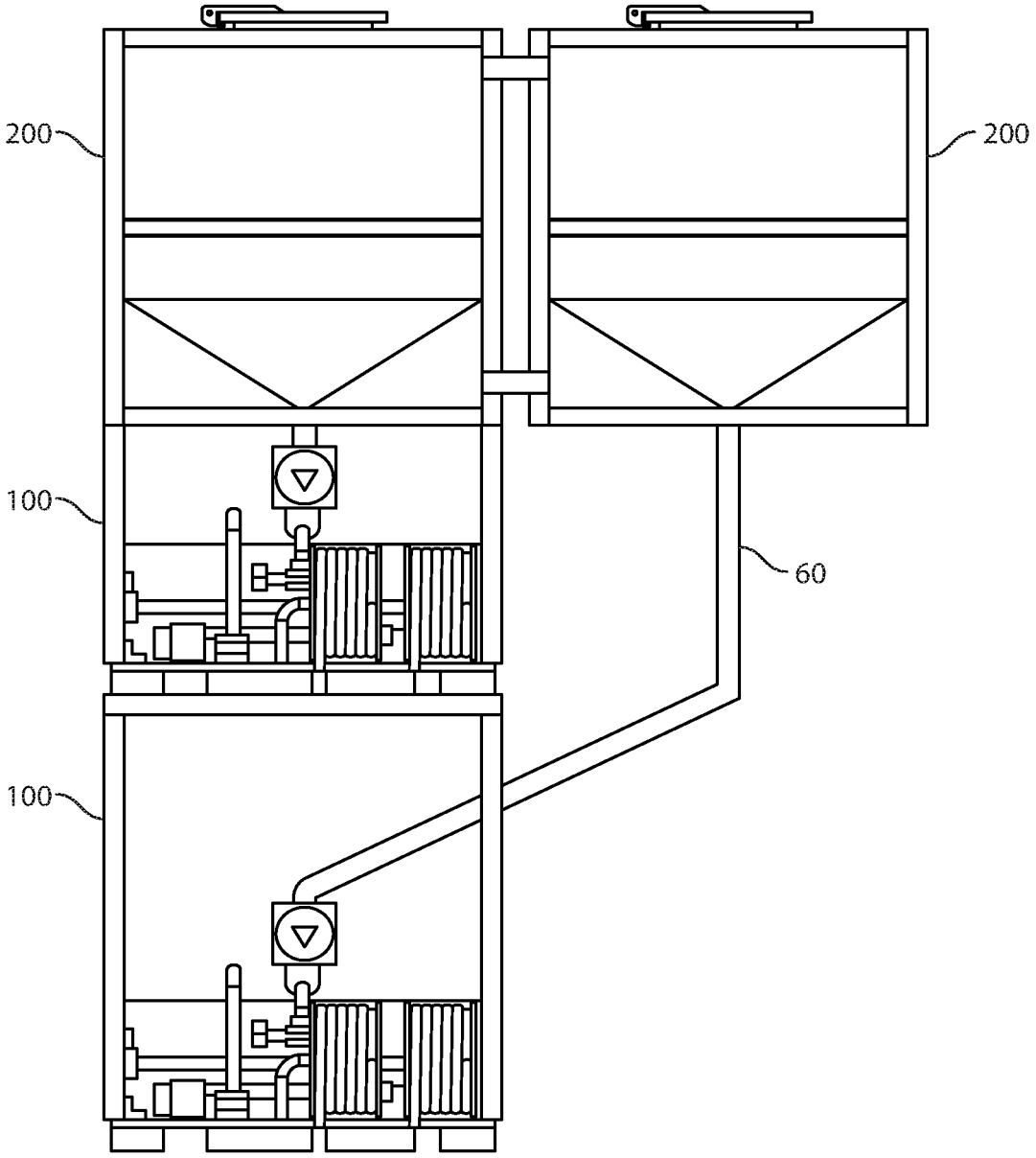
FIG. 34 is a side view of another embodiment of the system including two first modules and two second modules.

In still another embodiment, the first and second modules 100, 200 may be configured in any number of functional arrangements. For example, multiple first modules 100 may be stacked whereby the uppermost first module 100 makes use of a second module 200 as described above. An additional second module 200 may be set adjacent the main second module 200 and a chute or conduit 60 may be provided to convey dry additive in adjacent storage container 206 with the mixing line 160 of the bottom first module 100 as shown in FIG. 34. As shown, the bottom first module 100 may include vertical members 115 or raised horizontal rail type support member 114 of a length effective to provide clearance for the conduit 60.

The invention will be better understood with reference to the following non-limiting example, which is illustrative only and not intended to limit the present invention to a particular embodiment.

EXAMPLE 1

In a first non-limiting example, a system 10 as shown in FIG. 1 operationally configured for oil and gas extraction operations may be provided having the dimensions as shown in Table 3 below.

TABLE 3

| | |
|---|---|
| (1) | First Module 100<br>Framework 105 Width: about 1.93 meters (about 76.0 inches)<br>Framework 105 Length: about 2.54 meters (about 100.0 inches)<br>Height from the bottom of the Framework 105 to the top of the Vertical Members 115: about 1.55 meters (about 61.2 feet) |
| (2) | Second Module 200<br>Framework 205 Width: about 1.93 meters (about 76.0 inches)<br>Framework 205 Length: about 2.54 meters (about 100.0 inches)<br>Framework 205 Height: about 2.22 meters (about 87.25 inches) |
| (3) | Storage Container 206 Volume: about 7.79 cubic meters (about 275.0 cubic feet). |

In still another aspect, the present application is directed to a system for producing fluid mixture compositions, including a first module for providing fluid; and a second module attachable to the first module for providing dry additive to be mixed with the fluid; the system being operationally configured to mix fluid and dry additive to produce a fluid mixture composition and optionally modify the fluid mixture composition.

The present application is also directed to a system and method for mixing fluid and dry material, including system having a first module for providing a fluid stream; a second module for providing dry material into the fluid stream to produce a fluid mixture composition; the first module being operationally configured to house the fluid mixture composition, modify the fluid mixture composition and direct the fluid mixture composition out from the system.

The present application is also directed to a system and method for mixing fluid and dry material, including a system having a first module; and a second module attachable to the first module; wherein the first module is operationally configured to provide a fluid stream and the second module is operationally configured to provide dry additive into the fluid stream to produce a fluid mixture composition; the first module being operationally configured to house the fluid mixture composition, modify the fluid mixture composition and direct the fluid mixture composition out from the system. The first module can be operated alone or independent of the second module and vice versa.

It is believed that the present application and advantages will be understood by the forgoing description. Persons of ordinary skill in the art will recognize that many modifications may be made to the present application without departing from the spirit and scope of the invention. The embodiment(s) described herein are meant to be illustrative only and should not be taken as limiting the invention, which is defined in the claims.

I claim:

1. A system for producing one or more fluid mixture compositions, including:

a first module providing one or more fluids, the first module comprising:

a portable support platform;

a tub attached to the portable support platform; and one or more raised members attached to the portable support platform; and a second module providing one or more dry additives, the second module comprising:

a framework; and one or more dry additive storage containers secured to the framework;

wherein the one or more raised members of the first module are configured to support the second module apart from the tub in a stacked configuration;

wherein the first module is configured to receive the one or more dry additives from the one or more dry additive storage containers and mix the one or more dry additives with the one or more fluids to produce the one or more fluid mixture compositions; and wherein the first module is configured to modify the one or more fluid mixture compositions.

2. The system of claim 1 wherein the tub includes a wall member dividing the tub into a first basin and a second basin in fluid communication with the first basin.

3. The system of claim 2 wherein the first module includes a fluid inlet for receiving the one or more fluids and a first mixer in fluid communication with the fluid inlet configured to receive the one or more dry additives from the one or more dry additive storage containers of the second module and mix the one or more dry additives with the one or more fluids to produce the one or more fluid mixture compositions, and wherein the first basin is configured to receive the one or more fluid mixture compositions from the first mixer.

4. The system of claim 3 wherein the second basin is configured to receive the fluid mixture composition from the first basin.

5. The system of claim 3 wherein the one or more dry additive storage containers of the second module include an outlet and the first module includes a mixing head member in communication with the first mixer and the outlet of the one or more dry additive storage containers, wherein the mixing head member is configured to control the amount of one or more dry additives entering the first mixer from the one or more dry additive storage containers.

6. The system of claim 3 wherein the tub includes sidewalls of a height defining a perimeter of the tub, wherein the wall member has a height less than the height of the sidewalls, and wherein the second basin is configured to receive a modified fluid mixture composition from the first basin via a second mixer in fluid communication with the first basin and the second basin.

7. The system of claim 6 wherein the second mixer is a shear mixer.

8. The system of claim 6 wherein the second mixer is a conditioning pump.

9. The system of claim 2 wherein the first module includes one or more fluid outlets in fluid communication with the second basin for discharging of the one or more fluid mixture compositions from the system.

10. The system of claim 9 wherein the first module includes a progressive cavity pump in fluid communication with the second basin and in fluid communication with the one or more fluid outlets of the first module for discharging the one or more fluid mixture compositions from the system.

11. The system of claim 1 wherein the tub includes a first outlet for discharging the one or more fluid mixture compositions from the tub and a second outlet for discharging the one or more fluid mixture compositions from the tub, wherein the first module includes (1) a first conduit in fluid communication with the first outlet and a second conduit in fluid communication with the second outlet, (2) a first hose reel in fluid communication with the first conduit and a second hose reel in fluid communication with the second conduit wherein the first hose reel and the second hose reel are secured to the portable support platform, and (3) a first hose in fluid communication with the first hose reel for discharging the one or more fluid mixture compositions from the system and a second hose in fluid communication with the second hose reel for discharging the one or more fluid mixture compositions from the system.

12. The system of claim 1 wherein the first module may be operated independent of operation of the second module.

13. The system of claim 1 wherein the first module includes a fluid inlet comprising a flow control valve configured to control fluid flow into the system.

14. A portable system for producing one or more fluid mixture compositions, including:

a first module providing one or more fluids; and a second module providing one or more dry additives to be mixed with the one or more fluids to produce the one or more fluid mixture compositions;

wherein the first module includes:

a base support;

a fluid inlet for receiving the one or more fluids;

a first mixer for mixing the one or more dry additives with the one or more fluids to produce the one or more fluid mixture compositions;

a tub on the base support comprising a first basin for receiving the one or more fluid mixture compositions from the first mixer;

one or more raised members attached to the base support;

a conduit having a first end in fluid communication with the first basin;

and a second mixer on the base support in fluid communication with the conduit and configured to modify the one or more fluid mixture compositions received by the first basin of the tub;

wherein the second module includes:

a framework; and one or more dry additive storage containers secured to the framework;

wherein the one or more raised members of the first module are configured to engage the framework of the second module to support the second module atop the first module in a stacked configuration; and wherein the first module is operationally configured to direct the one or more fluid mixture compositions out from the system.

15. The system of claim 14 wherein the tub includes a divider defining the first basin and a second basin for receiving a modified fluid mixture composition from the first basin.

16. The system of claim 15 wherein the second basin is fluidly communicated with the first basin via (1) flow of the one or more fluid mixture compositions over the divider from the first basin into the second basin and (2) pumping the one or more fluid mixture compositions through the conduit from the first basin to the second basin via the second mixer.

17. A system for producing one or more fluid mixture compositions, including:

a plurality of individual systems including at least a first system and a second system, the first system and the second system each comprising:

a first module including:

a portable support platform;

a tub attached to the portable support platform;

a main line conduit in fluid communication with the tub, the main line conduit comprising a main line inlet configured to receive supply fluid from one or more fluid sources external the system and a main line outlet configured to discharge the supply fluid out from the main line conduit;

a first mixer in fluid communication with the main line conduit and in fluid communication with the tub;

a second mixer in fluid communication with the tub;

a discharge outlet in fluid communication with the tub for discharging the one or more fluid mixture compositions out from the first module; and one or more raised members attached to the portable support platform; and a second module including:

a framework; and one or more dry additive storage containers secured to the framework;

wherein the one or more raised members of the first module are configured to support the second module in a stacked configuration;

wherein the first mixer is configured to mix the supply fluid with the one or more dry additives received from the one or more dry additive storage containers to produce the one or more fluid mixture compositions and convey the one or more fluid mixture compositions into the tub;

wherein the second mixer is configured to receive the one or more fluid mixture compositions from the tub, facilitate further mixing of the one or more fluid mixture compositions and transfer the one or more fluid mixture compositions to the tub; and wherein the first system and the second system are fluidly communicated with the one or more fluid sources by fluidly communicating the main line inlet of the first module of the first system with the one or more fluid sources and fluidly communicating the main line inlet of the first module of the second system with the main line outlet of the first module of the first system.

18. The system of claim 17 wherein the second mixer is a shear mixer.

* * * * *